US008828639B2

(12) United States Patent
Kamikura et al.

(10) Patent No.: US 8,828,639 B2
(45) Date of Patent: Sep. 9, 2014

(54) TONER

(75) Inventors: Kenta Kamikura, Mishima (JP); Kazumi Yoshizaki, Suntou-gun (JP); Yasushi Katsuta, Susono (JP); Kenichi Nakayama, Numazu (JP); Shiro Kuroki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/824,337

(22) PCT Filed: Oct. 3, 2011

(86) PCT No.: PCT/JP2011/073168

§ 371 (c)(1),
(2), (4) Date: Mar. 15, 2013

(87) PCT Pub. No.: WO2012/046827

PCT Pub. Date: Apr. 12, 2012

(65) Prior Publication Data

US 2013/0177845 A1 Jul. 11, 2013

(30) Foreign Application Priority Data

Oct. 4, 2010 (JP) ..... 2010-225000

(51) Int. Cl.
*G03G 9/08* (2006.01)
*G03G 9/087* (2006.01)

(52) U.S. Cl.
CPC ..... *G03G 9/08702* (2013.01); *G03G 9/08795* (2013.01); *G03G 9/08791* (2013.01); *G03G 9/08797* (2013.01); *G03G 9/0821* (2013.01); *G03G 9/0806* (2013.01)
USPC ..... 430/111.4

(58) Field of Classification Search
CPC ..... G03G 9/0821
USPC ..... 430/111.4
See application file for complete search history.

(56) References Cited

U.S. PATENT DOCUMENTS

| | | | |
|---|---|---|---|
| 5,741,617 | A | 4/1998 | Inaba et al. |
| 5,856,055 | A | 1/1999 | Ugai et al. |
| 5,994,019 | A | 11/1999 | Okado et al. |
| 6,077,635 | A | 6/2000 | Okado et al. |
| 6,124,067 | A | 9/2000 | Mikuriya et al. |
| 6,137,977 | A | 10/2000 | Okado et al. |
| 6,312,862 | B1 | 11/2001 | Okado et al. |
| 6,316,157 | B1 | 11/2001 | Yoshizaki et al. |
| 6,346,356 | B1 | 2/2002 | Ohno et al. |
| 6,372,400 | B1 | 4/2002 | Yoshizaki et al. |
| 6,506,531 | B1 | 1/2003 | Hakata et al. |
| 6,667,140 | B2 | 12/2003 | Tosaka et al. |
| 6,855,471 | B2 | 2/2005 | Katsuta et al. |
| 6,936,394 | B2 | 8/2005 | Okado et al. |
| 7,029,813 | B2 | 4/2006 | Mikuriya et al. |
| 7,112,393 | B2 | 9/2006 | Komoto et al. |
| 7,153,625 | B2 | 12/2006 | Kaburagi et al. |
| 7,160,663 | B2 | 1/2007 | Komoto et al. |
| 7,241,546 | B2 | 7/2007 | Moriki et al. |
| 7,252,917 | B2 | 8/2007 | Ohno et al. |
| 7,323,282 | B2 | 1/2008 | Ohno et al. |
| 7,387,860 | B2 | 6/2008 | Moriki et al. |
| 7,459,253 | B2 | 12/2008 | Abe et al. |
| 7,537,875 | B2 | 5/2009 | Mikuriya et al. |
| 7,846,631 | B2 | 12/2010 | Katsuta et al. |
| 8,053,156 | B2 | 11/2011 | Abe et al. |
| 8,084,178 | B2 | 12/2011 | Tosaka et al. |
| 8,247,147 | B2 | 8/2012 | Abe et al. |
| 8,450,039 | B2 | 5/2013 | Matsuoka et al. |
| 2009/0117483 | A1 | 5/2009 | Inaba et al. |
| 2009/0186290 | A1 | 7/2009 | Yoshizaki et al. |
| 2009/0263738 | A1 | 10/2009 | Kaya et al. |
| 2012/0328979 | A1 | 12/2012 | Yoshizaki et al. |
| 2013/0164666 | A1 | 6/2013 | Abe et al. |

FOREIGN PATENT DOCUMENTS

| | | | |
|---|---|---|---|
| JP | 8-50367 | A | 2/1996 |
| JP | 2009-122653 | A | 6/2009 |
| JP | 2009-216914 | A | 9/2009 |
| JP | 2010-91787 | A | 4/2010 |
| TW | 200632600 | | 9/2006 |
| TW | 200702953 | | 1/2007 |
| TW | 200912569 | | 3/2009 |
| WO | 2008/126865 | A1 | 10/2008 |
| WO | 2009/011424 | A1 | 1/2009 |
| WO | 2009/113488 | A1 | 9/2009 |

OTHER PUBLICATIONS

PCT International Search Report and Written Opinion of the International Searching Authority, International Application No. PCT/JP2011/073168, Mailing Date Nov. 15, 2011.
Taiwanese Office Action dated Dec. 23, 2013 in Taiwanese Application No. 100135911.

*Primary Examiner* — Mark A Chapman
(74) *Attorney, Agent, or Firm* — Fitzpatrick, Cella, Harper and Scinto

(57) ABSTRACT

The invention provides a toner that is capable of low-temperature fixing even in high-speed electrophotographic processes while keeping the cleaning performance when used at high temperatures and the high-temperature storage stability. This toner having toner particles, each of which contains a binder resin and a colorant is characterized in that the temperature of Tp [° C.] when the loss elastic modulus obtained by dynamic viscoelastic measurements on the toner exhibits a maximum value in the temperature range from at least 30° C. to not more than 200° C., is from at least 40° C. to not more than 55° C., and in that, with G"(Tp) [Pa] being this maximum value, G"(Tp+15) [Pa] being the loss elastic modulus at the temperature of Tp+15 [° C.], and G"(Tp+30) [Pa] being the loss elastic modulus at the temperature of Tp+30 [° C.], G"(Tp), G"(Tp+15), and G"(Tp+30) satisfy prescribed relationships.

5 Claims, No Drawings

TONER

TECHNICAL FIELD

The present invention relates to the toner used in image-forming methods such as electrophotographic methods, electrostatic recording methods, magnetic recording methods, and toner jet methods.

BACKGROUND ART

The printing speeds in laser printers and copiers that use electrophotographic systems have been undergoing dramatic increases in recent years. This has created demand for toners that exhibit better durabilities and better low-temperature fixabilities. In particular, low-temperature fixability, in view of its connection to reducing power consumption, has come to be an essential requirement in toner development in recent years given the strong demands on toner development for environmental responsiveness.

In addition, as the market for laser printers and copiers has grown broader, the requirement has arisen that the toner be stable and exhibit its properties even when stored in a high temperature environment. Moreover, the elimination of fans from the interior of image-forming apparatuses in pursuit of smaller and quieter image-forming apparatuses has resulted in increasingly elevated temperatures within image-forming apparatuses. As a consequence, a high storage stability under even higher temperatures has come to be required of toner.

Given this background, there have been investigations of toners that have a so-called core-shell structure, in which, in order to satisfy the low-temperature fixability, the core is formed of a binder resin that encompasses a wax and, in order to satisfy the requirements for a high development durability and a high storage stability, the shell is formed of a resin that has a high glass-transition temperature or a resin that has a high molecular weight.

For example, with the objects of achieving oilless fixing and improving the transmissiveness of OHT images, Patent Document 1 discloses a suspension polymerized toner that encompasses an ester wax.

With the object of improving the developing performance, transfer performance, and fixing performance of toner, Patent Document 2 discloses a wax-encompassing toner comprising a styrene-butyl acrylate copolymer core coated with a shell of a styrene-methacrylic acid-methyl methacrylate copolymer.

[Patent Document 1] Japanese Patent Application Laid-open No. H8-050367

[Patent Document 2] WO 2008/126865

DISCLOSURE OF THE INVENTION

The toners according to the above-described public documents certainly exhibit excellent characteristics. However, when these were extended to electrophotographic processes that operated at speeds higher than in the past, it was found that further improvements in the cleaning performance would be required in the case of use at high temperatures. It was also found that additional improvements in the storage stability would be required in the case of storage in a high-temperature environment.

The present invention provides a toner that, while keeping the cleaning performance when used at high temperatures and the high-temperature storage stability, is capable of low-temperature fixing even in high-speed electrophotographic processes.

As a result of focused investigations, the present inventors found that the above-described problems are solved by controlling the loss elastic modulus (also referred to below as G") obtained by dynamic viscoelastic measurements on the toner. The present invention was achieved based on this finding.

Thus, the present invention is a toner having toner particles, each of which contains a binder resin and a colorant, the toner being characterized in that, when dynamic viscoelastic properties of the toner are measured in a temperature range from at least 30° C. to not more than 200° C., i)

with Tp [° C.] being a temperature at which a loss elastic modulus exhibits the maximum value, Tp is from at least 40° C. to not more than 55° C., and ii) with G"(Tp) [Pa] being the loss elastic modulus at the temperature of Tp [° C.], G"(Tp+15) [Pa] being the loss elastic modulus at the temperature of Tp+15 [° C.], and G"(Tp+30) [Pa] being the loss elastic modulus at the temperature of Tp+30 [° C.], G"(Tp), G"(Tp+15), and G"(Tp+30) satisfy following equations (1), (2), and (3):

$$8.00\times10^{7}\leq G''(Tp)\leq3.00\times10^{8} \quad (1)$$

$$G''(Tp)/G''(Tp+15)\leq6.00 \quad (2)$$

$$50.0\leq G''(Tp+15)/G''(Tp+30) \quad (3).$$

The present invention can provide a toner that—while keeping the cleaning performance when used at high temperatures, for example, when the temperature in the machine has risen, and the high-temperature storage stability—is capable of low-temperature fixing even in high-speed electrophotographic processes.

MODE FOR CARRYING OUT THE INVENTION

In dynamic viscoelastic measurements of the toner in the temperature range from at least 30° C. to not more than 200° C., the toner of the present invention is characterized in that Tp, which is the temperature at which the loss elastic modulus (also referred to below as G") exhibits the maximum value, resides in a prescribed range, the maximum value of G" resides in a prescribed range, the ratio between the maximum value of G" and G" at a specific temperature resides in a prescribed range, and the ratio of the G"'s at two specific temperatures resides in a prescribed range. In addition, by adjusting these parameters into the prescribed ranges, even for machines having a fast image-forming speed, the reduction in cleaning performance during use at high temperatures—for example, when the temperature in the machine has risen—can be inhibited and the low-temperature fixability and high-temperature storage stability can be simultaneously satisfied.

The inventors hypothesize as follows with regard to the reasons why the above-described problems are solved in the present invention.

The cleaning performance, storage stability, and low-temperature fixability of a toner are generally strongly correlated with the hardness of the toner at its temperature. More particularly, the storage stability and low-temperature fixability are strongly correlated with the absolute value of the toner hardness. Thus, the storage stability benefits from a higher hardness, while the low-temperature fixability benefits from a greater softness. In the case of the cleaning performance, on the other hand, the hardness to be easily cleaned is determined by the combination with the cleaning blade and because of this the cleaning performance correlates more strongly with changes in the toner hardness than with the absolute value of the toner hardness. Namely, when the toner hardness is readily susceptible to alteration, the toner hardness may end up outside the region in which cleaning is easily performed by the cleaning blade, which in turn causes a deterioration in the cleaning performance. In view of the preceding, it can be concluded that the cleaning performance benefits from smaller changes in toner hardness.

The temperature dependence of the hardness of a resin is, as a general matter, often evaluated through the dynamic viscoelasticity. Two pieces of information are obtained from dynamic viscoelastic measurements on a resin, the storage elastic modulus (also referred to as G' below), which is the elastic element, and the loss elastic modulus (G"), which is the viscous element. Here, G" has a maximal value during a phase transition and in particular has a maximum value in the vicinity of the glass-transition temperature (also referred to as Tg below). On the other hand, the value of G' is known to undergo a large decline in the vicinity of Tg.

When the relationship to the toner cleaning performance is considered, G' has large values at temperatures up to the Tg of the toner, and as a consequence there is a large elastic resistance and the toner resists deformation. In addition, at temperatures in the vicinity of the Tg of the toner, the value of G' declines while G" assumes large values, and as a consequence there is a large viscous resistance and the toner again resists deformation. On the other hand, at temperatures above the Tg of the toner, both G' and G" assume low values, and as a consequence the toner is then easily deformed. Namely, when the cleaning blade has been set for easy cleaning in a low-temperature environment, the cleaning performance is then easily impaired when the temperature in the image-forming apparatus during cleaning exceeds the Tg of the toner. While establishing a high Tg for the toner can be contemplated for solving this problem, this impairs the low-temperature fixability and thus is disfavored.

The present invention sets Tp [° C.], which corresponds to the Tg of the toner, at a low temperature of from at least 40° C. to not more than 55° C. and sets the maximum value G"(Tp) of G" at from at least $8.00\times10^7$ (Pa) to not more than $3.00\times10^8$ (Pa). In addition to this, the ratio between G"(Tp) and G"(Tp+15) is made not more than 6.00, and the ratio between G"(Tp+15) and G"(Tp+30) is made at least 50.0.

Based on the preceding, with the toner of the present invention, notwithstanding the fact that the toner has a low Tg, there is little change in toner hardness even above the toner Tg in the region where the temperature is somewhat higher, i.e., Tp+15 [° C.], and as a consequence the cleaning performance can be maintained. In addition, the storage stability is also excellent due to the high G"(Tp). On the other hand, the low-temperature fixability is also excellent since the toner has been designed to be soft in a higher temperature range, i.e., Tp+30 [° C.]. The inventors believe that the toner of the present invention exhibits excellent characteristics due to the three factors given above.

In the present invention, Tp, which is the temperature when the loss elastic modulus of the toner exhibits its maximum value, is from at least 40° C. to not more than 55° C. Tp is more preferably from at least 42° C. to not more than 53° C.

When the temperature of Tp at which the above-described maximum value occurs is from at least 40° C. to not more than 55° C., the cleaning performance is improved due to synergistic effects with the other conditions in the invention of the present application, and in addition the storage stability at high temperatures can co-exist with the low-temperature fixability. Among the preceding, Tp, because it is related to the Tg of the toner, makes a large contribution to the low-temperature fixability and the storage stability. Additional improvements in the above-described effects are obtained when Tp is from at least 42° C. to not more than 53° C.

When Tp is less than 40° C., the toner then has a low Tg and the storage stability is impaired as a consequence.

When Tp exceeds 55° C., the toner then has a high Tg and the low-temperature fixability is impaired as a consequence. This Tp can be adjusted by, for example, controlling the glass-transition temperature of the binder resin.

The maximum value G"(Tp) [Pa] of the loss elastic modulus of the toner is from at least $8.00\times10^7$ to not more than $3.00\times10^8$ in the present invention. From at least $1.00\times10^8$ to not more than $2.00\times10^8$ is more preferred.

When this G"(Tp) is from at least $8.00\times10^7$ to not more than $3.00\times10^8$, the cleaning performance is improved due to synergistic effects with the other conditions in the present invention, and in addition the storage stability at high temperatures can co-exist with the low-temperature fixability. Among the preceding, G"(Tp), since it essentially represents the hardness of the toner at the Tg of the toner, makes a large contribution to the low-temperature fixability and storage stability. Additional improvements in the above-described effects are obtained when G"(Tp) is from at least $1.00\times10^8$ to not more than $2.00\times10^8$.

When G"(Tp) is less than $8.00\times10^7$, the toner is too soft at the Tg of the toner and an impaired storage stability is then prone to occur.

When G"(Tp) is more than $3.00\times10^8$, the toner is too hard at the Tg of the toner and an impaired low-temperature fixability is then prone to occur.

G"(Tp) can be adjusted, for example, by controlling the molecular weight of the binder resin or other resins.

G"(Tp)/G"(Tp+15), which is the ratio between G"(Tp) and G" at Tp+15 (° C.), is less than or equal to 6.00 in the present invention. It is more preferably greater than or equal to 1.50 and less than or equal to 5.50.

When this G"(Tp)/G"(Tp+15) is less than or equal to 6.00, the cleaning performance is improved due to synergistic effects with the other conditions in the invention of the present application, and in addition the storage stability at high temperatures can co-exist with the low-temperature fixability. Among the preceding, G"(Tp)/G"(Tp+15)—because it represents the ratio between the toner hardness in the vicinity of the toner Tg and the toner hardness at a temperature of 15° C. higher than the toner Tg and because it represents the toner hardness at a temperature above the toner Tg—makes a large contribution to the improvement in the cleaning performance and to the storage stability. Additional improvements in the above-described effects are obtained when G"(Tp)/G"(Tp+15) is less than or equal to 5.50.

When G"(Tp)/G"(Tp+15) exceeds 6.00, the toner hardness in the vicinity of the temperature of 15° C. higher than the toner Tg is inadequate in comparison to the toner hardness in the vicinity of the toner Tg, and as a consequence the cleaning performance and storage stability may be impaired.

G"(Tp)/G"(Tp+15) can be adjusted, for example, by incorporating two resins with different Tg's in the toner and also by controlling the compatibility between these two resins.

G"(Tp+15)/G"(Tp+30), which is the ratio between G"(Tp+15) and G" at Tp+30 (° C.), is greater than or equal to 50.0 in the present invention. Greater than or equal to 60.0 and less than or equal to 1000 is more preferred.

When G"(Tp+15)/G"(Tp+30) is greater than or equal to 50.0, the cleaning performance is improved due to synergistic effects with the other conditions in the invention of the present application, and in addition the storage stability at high temperatures can co-exist with the low-temperature fixability. Among the preceding, G"(Tp+15)/G"(Tp+30)—because it represents the ratio between the toner hardness in the vicinity of the temperature of 15° C. higher than the toner Tg and the toner hardness in the vicinity of the temperature of 30° C. higher than the toner Tg, makes a large contribution to the low-temperature fixability. Additional improvements in the above-described effects are obtained when G"(Tp+15)/G"(Tp+30) is greater than or equal to 60.0.

When G"(Tp+15)/G"(Tp+30) is less than 50.0, the toner is not soft enough at Tp+30 (° C.), which as a consequence can impair the low-temperature fixability.

G"(Tp+15)/G"(Tp+30) can be adjusted by controlling the molecular weight and degree of crystallinity of the binder resin, or by controlling the relationship between the toner Tg and melting point by incorporating a low softening point material, e.g., wax, in the toner, and also by incorporating two resins with different Tg's in the toner and controlling the compatibility between these two resins.

G"(Tp+15) [Pa] is preferably from at least $2.00\times10^7$ Pa to not more than $1.00\times10^8$ Pa in the present invention. From at least $3.00\times10^7$ Pa to not more than $7.00\times10^7$ Pa is more preferred.

A G"(Tp+15) from at least $2.00\times10^7$ Pa to not more than $1.00\times10^8$ Pa provides an even better toner hardness at Tp+15 (° C.) and thereby makes possible retention of the storage stability even during storage in environments with even higher temperatures.

G"(Tp+15) can be adjusted by incorporating two resins with different Tg's in the toner and also by controlling the compatibility between these two resins and their molecular weights.

The materials used in the toner of the present invention will be described in detail herebelow.

Known resins can be used without particular limitation as the binder resin that is used in the toner of the present invention.

Specific examples are as follows: vinyl resins, polyester resins, polyamide resin, furan resins, epoxy resins, xylene resins, silicone resins, and so forth. A single one of these resins or a mixture of these resins can be used. The vinyl resin can be a homopolymer or copolymer of the following monomers: styrenic monomers as typified by styrene, α-methylstyrene, and divinylbenzene; unsaturated carboxylic acid esters as typified by methyl acrylate, butyl acrylate, methyl methacrylate, 2-hydroxyethyl methacrylate, t-butyl methacrylate, and 2-ethylhexyl methacrylate; unsaturated carboxylic acids as typified by acrylic acid and methacrylic acid; unsaturated dicarboxylic acids as typified by maleic acid; unsaturated dicarboxylic acid anhydrides as typified by maleic anhydride; nitrile-type vinyl monomers as typified by acrylonitrile; halogen-containing vinyl monomers as typified by vinyl chloride; and nitro-type vinyl monomers as typified by nitrostyrene.

The heretofore known pigments, dyes, magnetic materials, and so forth, in black, yellow, magenta, cyan, or another color can be used without particular limitation as the colorant used in the toner of the present invention.

In specific terms, a black pigment as typified by carbon black can be used as the black colorant.

The yellow colorant can be specifically exemplified by yellow pigments and yellow dyes as typified by the following: monoazo compounds, disazo compounds, condensed azo compounds, isoindolinone compounds, benzimidazolone compounds, anthraquinone compounds, azo metal complexes, methine compounds, and allylamide compounds.

The magenta colorant can be specifically exemplified by magenta pigments and magenta dyes as typified by the following: monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

The cyan colorant can be specifically exemplified by cyan pigments and cyan dyes as typified by the following: copper phthalocyanine compounds and derivatives thereof, anthraquinone compounds, and basic dye lake compounds.

The colorant content is preferably from 1 to 20 mass parts per 100 mass parts of the binder resin.

The toner of the present invention may also be a magnetic toner provided by the incorporation of a magnetic material. In this case, the magnetic material may also double as a colorant. The magnetic material can be exemplified by the following: iron oxides as typified by magnetite, hematite, and ferrite; metals as typified by iron, cobalt, and nickel; and alloys and mixtures of these metals with metals such as aluminum, cobalt, copper, lead, magnesium, tin, zinc, antimony, beryllium, bismuth, cadmium, calcium, manganese, selenium, titanium, tungsten, and vanadium.

The toner particles in the toner of the present invention preferably contain a polar resin. In the present invention, this polar resin denotes a resin that has the carboxyl group in its structure.

Known resins that contain the carboxyl group can be used without particular limitation as the polar resin used in the toner of the present invention. Specific examples are carboxyl group-containing vinyl resins, carboxyl group-containing polyester resins, carboxyl group-containing polyurethane resins, and carboxyl group-containing polyamide resins. The following can be used as the carboxyl group-containing vinyl resin: homopolymers of a carboxyl group-containing monomer as typified by unsaturated carboxylic acids and unsaturated dicarboxylic acids, and copolymers of these carboxyl group-containing monomers with, for example, styrene-type monomers, unsaturated carboxylic acid esters, unsaturated dicarboxylic acid anhydrides, nitrile-type vinyl monomers, halogen-containing vinyl monomers, and nitro-type vinyl monomers.

Viewed from the perspective of the improvement in the cleaning performance and the balance between the low-temperature fixability and storage stability, two polar resins with different Tg's are preferably used in combination as the polar resin. Preferably one of these polar resins has a Tg (Tg1) from at least 65° C. to not more than 85° C. and the other one of the polar resins has a Tg (Tg2) from at least 75° C. to not more than 105° C.

The polar resin content, expressed per 100 mass parts of the binder resin, is preferably from at least 5 mass parts to not more than 30 mass parts and more preferably is from at least 10 mass parts to not more than 30 mass parts.

The use of a carboxyl group-containing vinyl resin is preferred among the preceding in the present invention from the standpoint of the ease of controlling the compatibility with the binder resin, while the co-use with a carboxyl group-containing polyester resin is more preferred.

The reason why the co-use of a carboxyl group-containing vinyl resin with a carboxyl group-containing polyester resin is more preferred is as follows.

In the case of a method of producing toner in which a carboxyl group-containing polyester resin readily forms the surfacemost layer of the toner, as in suspension polymerization methods, the carboxyl group-containing vinyl resin, since it is attracted to the carboxyl group-containing polyester resin present surfacemost in the toner, readily undergoes greater segregation to the toner surface than in toner that does not use a carboxyl group-containing polyester resin. As a consequence, the inventors believe that the region in which the carboxyl group-containing vinyl resin is compatible in the binder resin is made narrow and a toner that can satisfy the loss elastic modulus relationships specified by the present invention is then more easily obtained. The content of the carboxyl group-containing vinyl resin is preferably from at least 5 mass parts to not more than 25 mass parts per 100 mass parts of the binder resin. In addition, the content of the carboxyl group-containing polyester resin is preferably from at least 1 mass part to not more than 10 mass parts per 100 mass parts of the binder resin.

Moreover, the relationship $0.5 \leq Xa - Xb \leq 9.0$ is preferably satisfied where Xa (mN/m) is the interfacial tension with water, as determined by the pendant drop method, of the carboxyl group-containing vinyl resin dissolved in styrene and Xb (mN/m) is the interfacial tension with water, as determined by the pendant drop method, of the carboxyl group-containing polyester resin dissolved in styrene. When this relationship is satisfied, the presence of the carboxyl group-containing polyester resin in the surfacemost layer of the toner particle is facilitated even further during toner production by a suspension polymerization method.

Xa is preferably from at least 24.0 mN/m to not more than 35.0 mN/m, and Xb is preferably from at least 20.0 mN/m to not more than 34.0 mN/m.

With regard to particularly favorable specific examples of the carboxyl group-containing vinyl resin, a styrene resin in which the copolymerized components are at least one selection from the group consisting of styrene, o-(m-, p-)methylstyrene, and m-(p-)ethylstyrene and at least one selection from the group consisting of methacrylic acid and acrylic acid is preferred, while this styrene resin further containing a methacrylate ester and/or an acrylate ester as a copolymerized component is more preferred. Examples of preferred methacrylate esters and acrylate esters are methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, and 2-ethylhexyl methacrylate.

A particularly favorable specific example of the carboxyl group-containing polyester polar resin is the polyester resin produced using, in a component ratio at which the carboxyl group remain presents, a dibasic acid or anhydride thereof and a dihydric alcohol as essential components and, for example, a trifunctional or higher functional polybasic acid or anhydride thereof, a monobasic acid, a trifunctional or higher functional alcohol, and/or a monohydric alcohol on an optional basis, and using a method, for example, in which dehydration condensation is carried out at a reaction temperature of 180 to 260° C. while heating under a nitrogen atmosphere and measuring the acid value. The dibasic acid and anhydride thereof can be exemplified by aliphatic dibasic acids such as maleic acid, maleic anhydride, fumaric acid, itaconic acid, itaconic anhydride, oxalic acid, malonic acid, succinic acid, succinic anhydride, dodecylsuccinic acid, dodecylsuccinic anhydride, dodecenylsuccinic acid, dodecenylsuccinic anhydride, adipic acid, azelaic acid, sebacic acid, and decane-1,10-dicarboxylic acid, and by aromatic or alicyclic dibasic acids such as phthalic acid, tetrahydrophthalic acid and its anhydride, hexahydrophthalic acid and its anhydride, tetrabromophthalic acid and its anhydride, tetrachlorophthalic acid and its anhydride, HET acid and its anhydride, himic acid and its anhydride, isophthalic acid, terephthalic acid, cyclohexanedicarboxylic acid, and 2,6-naphthalenedicarboxylic acid.

The dihydric alcohol can be exemplified by aliphatic diols such as ethylene glycol, 1,2-propylene glycol, 1,4-butanediol, 1,5-pentanediol, 1,6-hexanediol, diethylene glycol, dipropylene glycol, triethylene glycol, and neopentyl glycol; bisphenols such as bisphenol A and bisphenol F; bisphenol A/alkylene oxide adducts such as the ethylene oxide adduct on bisphenol A and the propylene oxide adduct on bisphenol A; aralkylene glycols such as xylylene diglycol; and alicyclic diols such as 1,4-cyclohexanedimethanol and hydrogenated bisphenol A.

The trifunctional and higher functional polybasic acids and their anhydrides can be exemplified by trimellitic acid, trimellitic anhydride, methylcyclohexene tricarboxylic acid, methylcyclohexene tricarboxylic anhydride, pyromellitic acid, and pyromellitic anhydride.

In the present invention, the carboxyl group-containing vinyl resin preferably has a weight-average molecular weight (also referred to below as Mw), as measured by gel permeation chromatography (GPC), of from at least $1.00 \times 10^4$ to not more than $5.00 \times 10^4$. From at least $1.20 \times 10^4$ to not more than $3.00 \times 10^4$ is more preferred.

Even when the toner of the present invention is used in even higher speed electrophotographic processes, an Mw of from at least $1.00 \times 10^4$ to not more than $5.00 \times 10^4$ makes it possible to maintain a better cleaning performance, even after long-term use, and to inhibit toner deterioration after use, and to achieve these effects while maintaining the low-temperature fixability. These effects are improved still further with an Mw of from at least $1.20 \times 10^4$ to not more than $3.00 \times 10^4$. This Mw can be controlled by controlling the reaction conditions during synthesis of the polar vinyl resin, e.g., the reaction temperature, amount of initiator, and so forth.

The peak molecular weight (also referred to below as Mp) of the carboxyl group-containing vinyl resin in the molecular weight distribution measured by gel permeation chromatography (GPC) is preferably from at least $1.00 \times 10^4$ to not more than $3.00 \times 10^4$. In addition, letting the high molecular weight component be the resin component that elutes in gel permeation chromatography (GPC) prior to the elution time that gives the peak molecular weight (Mp) and letting the low molecular weight component be the resin component that elutes after the elution time that gives the peak molecular weight (Mp), the acid value $\alpha$ [mg KOH/g] of this low molecular weight component and the acid value $\beta$ [mg KOH/g] of this high molecular weight component preferably satisfy the relationship $0.80 \leq \alpha/\beta \leq 1.20$. They more preferably satisfy the relationship $0.85 \leq \alpha/\beta \leq 1.15$.

The acid value distribution in the carboxyl group-containing vinyl resin becomes uniform when the above-described Mp is from at least $1.00 \times 10^4$ to not more than $3.00 \times 10^4$ and $0.80 \leq \alpha/\beta \leq 1.20$ is satisfied, and this can effectively inhibit the exudation of low molecular weight substances produced during storage in a high-temperature environment, which can cause a decline in the loss elastic modulus. This makes possible a better retention of the cleaning performance even after the toner of the present invention has been stored in a high-temperature environment. These effects are further enhanced when $0.85 \leq \alpha/\beta \leq 1.15$ is satisfied.

The Mp can be adjusted by controlling the reaction conditions during synthesis of the carboxyl group-containing vinyl resin, e.g., the reaction temperature and amount of initiator. The above-described $\alpha/\beta$ can be adjusted, for example, by controlling the reaction system pressure and temperature during synthesis of the carboxyl group-containing vinyl resin or controlling the amount of dropwise addition of monomer that provides the prescribed composition during the reaction.

The weight-average molecular weight (Mw) of the carboxyl group-containing polyester resin as measured by gel permeation chromatography (GPC) is preferably from at least $3.00\times10^3$ to not more than $3.00\times10^4$, while its peak molecular weight (Mp) is preferably from at least $5.00\times10^4$ to not more than $2.00\times10^4$.

The toner of the present invention may also contain a wax. Specific examples are as follows: monofunctional ester waxes as typified by behenyl behenate, stearyl stearate, and palmityl palmitate; difunctional ester waxes as typified by dibehenyl sebacate and hexanediol dibehenate; trifunctional ester waxes as typified by glycerol tribehenate; tetrafunctional ester waxes as typified by pentaerythritol tetrastearate and pentaerythritol tetrapalmitate; hexafunctional ester waxes as typified by dipentaerythritol hexastearate and dipentaerythritol hexapalmitate; polyfunctional ester waxes as typified by polyglycerol behenate; natural ester waxes as typified by carnauba wax and rice wax; petroleum waxes and derivatives thereof, such as paraffin wax, microcrystalline wax, and petrolatum; hydrocarbon waxes produced by the Fischer-Tropsch method, and derivatives thereof; polyolefin waxes such as polyethylene wax and polypropylene wax, and derivatives thereof; higher aliphatic alcohols; aliphatic acids such as stearic acid and palmitic acid; and acid amide waxes. The use of an ester wax is preferred among the preceding in particular from the standpoint of ease of control of the compatibility with the binder resin.

The reason for the preference for ester waxes is as follows.

Among the waxes used in toners, ester waxes are characterized by facile compatibility with the binder resin. Due to this, by using an ester wax, the binder resin in the vicinity of the toner core readily forms a compatible state with the ester wax, while the polar resin is relatively poorly compatible in the binder resin, and as a result the polar resin more readily segregates to the surface of the toner.

The present inventors believe that a toner that can satisfy the loss elastic modulus relationships specified by the present invention is more easily obtained as a consequence.

The ester wax in the present invention refers to the pure ester or to a mixture of the ester with, e.g., the free fatty acid, free alcohol, hydrocarbon, and so forth, in which the ester content is at least 75 mass %. Thus, carnauba wax (80 to 85 mass % ester content) and rice wax (93 to 97 mass % ester content) are also ester waxes.

Viewed from the perspective of satisfying the storage stability and the low-temperature fixability, the use is preferred among the preceding waxes of waxes with a melting point from at least 65° C. to less than 80° C. and waxes in which the half width of an endothermic peak measured by differential scanning calorimetry (DSC) is not more than 4.0° C. A toner that satisfies the loss elastic modulus relationships specified by the present invention can be even more readily obtained through the use of an ester wax that satisfies these melting point and half width an endothermic peak conditions.

The toner of the present invention may also contain a charge control agent. The heretofore known charge control agents can be used without particular limitation as the charge control agent used in the toner of the present invention. Specific examples of negative-type charge control agents are as follows: metal compounds of aromatic carboxylic acids as typified by salicylic acid, alkylsalicylic acid, dialkylsalicylic acid, naphthoic acid, dicarboxylic acids, and so forth; polymers and copolymers that contain a sulfonic acid group, sulfonate group, or sulfonate ester group; the metal salts and metal complexes of azo dyes and azo pigments; boron compounds; silicon compounds; calixarene; and so forth. The positive-type charge control agents can be exemplified by the following: quaternary ammonium salts, polymeric compounds having a quaternary ammonium salt in side chain position, guanidine compounds, nigrosine compounds, imidazole compounds, and so forth. Usable as the polymers and copolymers that have a sulfonic group or sulfonate ester group are the homopolymers of sulfonic acid group-containing vinyl monomers as typified by styrenesulfonic acid, 2-acrylamido-2-methylpropanesulfonic acid, 2-methacrylamido-2-methylpropanesulfonic acid, vinylsulfonic acid, and methacrylsulfonic acid, and the copolymers of these sulfonic acid group-containing vinyl monomers with the vinyl monomers given above in the discussion of the binder resin.

The toner of the present invention may also contain a flowability improver. In this case, a preferred mode of use is external addition of the flowability improver to the toner particles.

The heretofore known flowability improvers can be used without particular limitation as the flowability improver used in the toner of the present invention. Specific examples are as follows: fluororesin powder, as typified by vinylidene fluoride fine powder and polytetrafluoroethylene fine powder; metal salts of fatty acids, as typified by zinc stearate, calcium stearate, and lead stearate; metal oxides, as typified by titanium oxide powder, aluminum oxide powder, and zinc oxide powder, as well as the powders provided by subjecting these metal oxides to a hydrophobic treatment; and fine silica powder as typified by wet silica and dry silica, as well as surface-treated fine silica powders as provided by executing a surface treatment on these silicas using a treatment agent as typified by silane coupling agents, titanium coupling agents, and silicone oils. The known amount of addition may also be used for the amount of addition of these flowability improvers.

Methods of producing the toner of the present invention are described in detail in the following.

The heretofore known methods can be used without particular limitation as the method of producing the toner of the present invention. Specific examples are suspension polymerization methods, solution suspension methods, emulsion aggregation methods, spray-drying methods, and pulverization methods. Production methods that include a step of granulation in an aqueous medium are particularly preferred among the preceding from the standpoint of the ease of production of a uniform core-shell structure, and suspension polymerization methods are even more preferred from the standpoint of enabling a more effective inclusion of low softening point substances. To obtain the toner of the present invention by a suspension polymerization method, a polymerizable monomer composition is prepared by uniformly dissolving or dispersing colorant and as necessary other substances, such as a polar resin, wax, charge control agent, and so forth, in polymerizable monomer. This polymerizable monomer composition is then dispersed using a suitable stirring device in an aqueous medium that may as necessary contain a dispersion stabilizer. Subsequent polymerization of the polymerizable monomer then provides toner particles having a desired particle diameter. After the completion of polymerization, the toner particles are filtered, washed, and dried by known methods and a flowability improver is mixed and attached to the surface as necessary to yield the toner particles of the present invention.

The polymerizable monomer used when the toner of the present invention is obtained by a suspension polymerization method can be exemplified by the vinyl monomers given in the discussion of the binder resin.

A polymerization initiator may also be used when the toner of the present invention is obtained by a suspension polymerization method. The known polymerization initiators can be used without particular limitation as the polymerization initiator used to produce the toner of the present invention. Specific examples are as follows: azo-type or diazo-type polymerization initiators as typified by 2,2'-azobis(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile, and by peroxide-type polymerization initiators as typified by benzoyl peroxide, t-butylperoxy 2-ethylhexanoate, t-butylperoxy pivalate, t-butylperoxy isobutyrate, t-butylperoxy neodecanoate, methyl ethyl ketone peroxide, diisopropyl peroxycarbonate, cumene hydroperoxide, 2,4-dichlorobenzoyl peroxide, and lauroyl peroxide.

The known chain transfer agents, polymerization inhibitors, and so forth, can also be used in the production of the toner of the present invention by a suspension polymerization method.

An inorganic or organic dispersion stabilizer may also be present in the aqueous medium when the toner of the present invention is obtained by a suspension polymerization method. The known dispersion stabilizers can be used without particular limitation as this dispersion stabilizer. Specific examples of inorganic dispersion stabilizers are as follows: phosphate salts as typified by hydroxyapatite, tricalcium phosphate, dicalcium phosphate, magnesium phosphate, aluminum phosphate, zinc phosphate, and so forth; carbonates as typified by calcium carbonate, magnesium carbonate, and so forth; metal hydroxides as typified by calcium hydroxide, magnesium hydroxide, aluminum hydroxide, and so forth; sulfate salts as typified by calcium sulfate, barium sulfate, and so forth; as well as calcium metasilicate, bentonite, silica, alumina, and so forth. The organic dispersion stabilizer can be exemplified by the following: polyvinyl alcohol, gelatin, methyl cellulose, methylhydroxypropyl cellulose, ethyl cellulose, the sodium salt of carboxymethyl cellulose, polyacrylic acid and its salts, starch, and so forth.

A surfactant may also be present in the aqueous medium when the toner of the present invention is obtained by a suspension polymerization method. The known surfactants can be used without particular limitation as this surfactant. Specific examples are as follows: anionic surfactants as typified by sodium dodecylbenzene sulfate and sodium oleate; cationic surfactants; amphoteric surfactants, and nonionic surfactants.

When an inorganic compound is used as the dispersion stabilizer, a commercial product may be directly used as such, or, in order to obtain relatively finer particles, use may be made of an inorganic compound as described above that has been produced in the aqueous medium. For example, in the case of a calcium phosphate such as hydroxyapatite or tricalcium phosphate, an aqueous phosphate salt solution may be mixed with an aqueous calcium salt solution under strong stirring.

The methods used to measure the property values of the toner of the present invention are described in detail below.

<Method of Measuring the Elastic Loss Modulus G" of the Toner>

The elastic loss modulus G" of the toner is determined as follows using a dynamic viscoelastic measurement method.

An ARES rotating plate rheometer (TA Instruments) is used as the measurement instrument.

For the measurement sample, a sample is used that is prepared in a 25° C. atmosphere using a tablet molder. The toner is compression molded into a disk with a diameter of 7.9 mm and a thickness of 2.0±0.3 mm to give the sample.

This sample is mounted in the parallel plates; the temperature is raised over 15 minutes from room temperature (25° C.) to 120° C. and the sample shape is adjusted; and cooling is carried out to the start temperature for the viscoelastic measurement and the measurement is started. Here, the sample is installed such that the initial normal force is 0. In addition, the influence of the normal force can be cancelled in the ensuing measurement as described below by setting the automatic tension adjustment (Auto Tension Adjustment) to ON. The measurement is performed using the following conditions.

(1) Parallel plates with a diameter of 7.9 mm are used.
(2) The frequency (Frequency) is set to 1.0 Hz.
(3) The initial applied strain value (Strain) is set to 0.1%.
(4) The measurement is performed at a rate of temperature rise (Ramp Rate) of 2.0° C./min between 30 and 200° C. The measurement is performed using the automatic adjustment mode settings given below. The measurement is performed in the automatic strain adjustment mode (Auto Strain).
(5) The maximum strain (Max Applied Strain) is set to 20.0%.
(6) The maximum torque (Max Allowed Torque) is set to 200.0 g·cm and the minimum torque (Min Allowed Torque) is set to 0.2 g·cm.
(7) The strain adjustment (Strain Adjustment) is set to 20.0% of Current Strain. The automatic tension adjustment mode (Auto Tension) is used for the measurement.
(8) The automatic tension direction (Auto Tension Direction) is set to compression (Compression).
(9) The initial static force (Initial Static Force) is set to 10.0 g and the automatic tension sensitivity (Auto Tension Sensitivity) is set to 40.0 g.
(10) With regard to the automatic tension (Auto Tension) operating condition, the sample modulus (Sample Modulus) is at least $1.0\times10^3$ (Pa).

<Method of Measuring the Weight-Average Molecular Weight and Number-Average Molecular Weight of the Polar Resin>

The molecular weight and molecular weight distribution of the polar resin were measured as follows by gel permeation chromatography (GPC).

First, the polar resin was dissolved in tetrahydrofuran (THF) over 24 hours at room temperature. The obtained solution was filtered using a "MYSHORI Disk" solvent-resistant membrane filter with a pore diameter of 0.2 μm (Tosoh Corporation) to obtain a sample solution. The sample solution was adjusted so as to provide a concentration of THF-soluble components of approximately 0.8 mass %. Measurement was performed under the following conditions using this sample solution.

instrument: HLC8120 GPC (detector: RI) (Tosoh Corporation)
columns: 7 column train of Shodex KF-801, 802, 803, 804, 805, 806, and 807 (Showa Denko KK)
eluent: tetrahydrofuran (THF)
flowrate: 1.0 mL/min
oven temperature: 40.0° C.
sample injection amount: 0.10 mL The sample molecular weight was determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Method of Measuring the Interfacial Tension of the Polar Resin Dissolved in Styrene>

The interfacial tension is measured in the present invention by the pendant drop method as described in the following. A DropMaster 700 FACE solid/liquid interface analyzer from Kyowa Interface Science Co., Ltd., is used in a 25° C. environment, and the measurement is performed using WIDE1 for the field of vision of the lens section. First, the tip of the capillary (inner diameter=0.4 mm) is introduced vertically downward into the styrene solution of the polar resin that is to be measured. The capillary is then connected to the syringe. Degassed ion-exchanged water is introduced into the syringe. 0.99 mass % is used for the concentration of the sample dissolved in the styrene. The syringe is then connected to an AUTO DISPENSER AD-31 (Kyowa Interface Science Co., Ltd.), and, by pushing the ion-exchanged water through the capillary, a droplet can be produced at the capillary tip within the styrene solution of the polar resin. The interfacial tension with water is determined from the shape of this droplet. The measurement and analysis system from Kyowa Interface Science Co., Ltd., is used for controlling production of the liquid droplet and for the calculation methodology. 0.1 g/cm$^3$, which is the density difference between water and styrene, is used for the density difference between the water and styrene solution required for the calculation. The final measurement result for the interfacial tension is the average value of ten measured values.

The low molecular weight component and high molecular weight component of the carboxyl group-containing vinyl resin refer in the present invention to the components collected in the gel permeation chromatography (GPC) described below before and after the elution time of the peak molecular weight (Mp) of the carboxyl group-containing vinyl resin. Accordingly, in the molecular weight distribution measured by gel permeation chromatography (GPC) on the carboxyl group-containing vinyl resin, the resin component that elutes earlier than the elution time for the peak molecular weight (Mp) is fractionated and taken to be the high molecular weight component and the resin component that elutes later than the elution time for the peak molecular weight (Mp) is fractionated and taken to be the low molecular weight component. Fractionation is specifically performed by the following method.

<Method for Fractionating the Low Molecular Weight Component and High Molecular Weight Component of the Carboxyl Group-Containing Vinyl Resin and Method of Measuring their Acid Values>

[Instrument Configuration]

LC-908 (Japan Analytical Industry Co., Ltd.)

JRS-86 (repeat injector, Japan Analytical Industry Co., Ltd.)

JAR-2 (autosampler, Japan Analytical Industry Co., Ltd.)

FC-201 (fraction collector, Gilson, Inc.)

[Column Configuration]

JAIGEL-1H to -5H (20ϕ×600 mm: preparative column)

[Measurement Conditions]

temperature: 40° C.

solvent: THF flow rate: 5 mL/min.

detector: RI

The sample to be fractionated was prepared using the same method as described above for measurement of the weight-average molecular weight of the polar resin. For the fractionation method, on the other hand, the elution time providing the peak molecular weight (Mp) of the carboxyl group-containing vinyl resin was preliminarily measured and the component that fractionated up to the elution time (including the elution time that provided Mp) was taken to be the high molecular weight component and the component that fractionated after the elution time (not including the elution time that provided Mp) was taken to be the low molecular weight component. The solvent was removed from the fractionated sample to provide the sample for measurement of the acid value.

The acid value α of the low molecular weight component and the acid value β of the high molecular weight component were measured by the following method. The acid value is the number of milligrams of potassium hydroxide required to neutralize the acid present in 1 g of a sample. The acid value of the polar resin was measured in accordance with JIS K 0070-1992. The measurement was specifically carried out by the following procedure.

(1) Reagent Preparation

A phenolphthalein solution was obtained by dissolving 1.0 g phenolphthalein in 90 mL ethyl alcohol (95 vol %) and bringing to 100 mL by the addition of ion-exchanged water.

7 g special-grade potassium hydroxide was dissolved in 5 mL water and brought to 1 L by the addition of ethyl alcohol (95 vol %). After standing for 3 days in a base-resistant container isolated from contact with, e.g., carbon dioxide, filtration was performed to obtain a potassium hydroxide solution. The obtained potassium hydroxide solution was stored in a base-resistant container. The factor for this potassium hydroxide solution was determined as follows: 25 mL of 0.1 mol/L hydrochloric acid was taken to an Erlenmeyer flask; several drops of the above-described phenolphthalein solution were added; titration was performed with the potassium hydroxide solution; and the factor was determined from the amount of the potassium hydroxide solution required for neutralization. The 0.1 mol/L hydrochloric acid was prepared based on JIS K 8001-1998.

(2) Procedure (A) The Main Test

A 2.0 g sample was precisely weighed into a 200-mL Erlenmeyer flask; 100 mL of a toluene:ethanol (2:1) mixed solution was added; and dissolution was carried out over 5 hours. Several drops of the above-described phenolphthalein solution were added as the indicator and titration was performed using the above-described potassium hydroxide solution. The endpoint for the titration was taken to be the point at which the pale pink color of the indicator persisted for approximately 30 seconds.

(B) The Blank Test

Titration was performed using the same procedure as described above, but omitting the sample, i.e., the toluene:ethanol (2:1) mixed solution was titrated by itself.

(3) The Acid Value was Calculated by Substituting the Obtained Results into the Following Equation.

$$A=[(C-B)\times f\times 5.61]/S$$

wherein

A: acid value (mg KOH/g)

B: amount of addition of the potassium hydroxide solution in the blank test (mL)

C: amount of addition of the potassium hydroxide solution in the main test (mL)

f: factor for the potassium hydroxide solution

S: sample (g)

<Method of Measuring the Glass-Transition Temperature (Tg) of the Polar Resin>

The glass-transition temperature of the polar resin is measured based on ASTM D 3418-82 using a Q1000 (TA Instruments) differential scanning calorimeter.

The melting points of indium and zinc are used for temperature correction in the instrument's detection section, and the heat of fusion of indium is used to correct the amount of heat.

Specifically, approximately 3 mg of the polar resin is accurately weighed out and placed in an aluminum pan and the measurement is carried out at a rate of temperature rise of 1° C./min in the measurement range of 20 to 140° C. using an empty aluminum pan for reference. The change in the specific heat is obtained in the 40° C. to 100° C. temperature range in this temperature ramp-up step. In this case, the glass-transition temperature Tg of the polar resin is taken to be the intersection of the differential heat curve with the line for the midpoint for the baseline prior to the appearance of a change in the specific heat and the baseline after the change in the specific heat has appeared.

<Method of Measuring the Melting Point of the Wax and the Half Width of the Endothermic Peak>

The melting point (peak top temperature of the highest endothermic peak) of the wax is measured based on ASTM D 3418-82 using a Q1000 (TA Instruments) differential scanning calorimeter.

The melting points of indium and zinc are used for temperature correction in the instrument's detection section, and the heat of fusion of indium is used to correct the amount of heat.

Specifically, approximately 3 mg of the wax is accurately weighed out and placed in an aluminum pan and the measurement is carried out at a rate of temperature rise of 1° C./min in the measurement temperature range of 30 to 200° C. using an empty aluminum pan for reference. The measurement is performed by raising the temperature to 200° C., then lowering the temperature to 30° C., and thereafter raising the temperature once again. The peak top temperature of the highest endothermic peak in the DSC curve in the 30 to 200° C. temperature range in this second temperature ramp-up step is taken to be the melting point of the wax in the present invention. In addition, the half width of the highest endothermic peak in this measurement is taken to be the half width of the endothermic peak for the wax.

<Method of Measuring the Degree of Agglomeration of the Toner>

The degree of agglomeration of the toner was measured as explained below. The test instrument consisted of a MODEL 1332A Digivibro digital-display vibrometer (Showa Sokki Corporation) connected to the side of the vibrating table of a Powder Tester (Hosokawa Micron Corporation). The following were installed stacked in sequence from bottom to top in the vibrating table of the Powder Tester: a sieve with an aperture of 38 μm (400 mesh) (sieve A), a sieve with an aperture of 75 μm (200 mesh) (sieve B), and a sieve with an aperture of 150 μm (100 mesh) (sieve C). The measurement was performed as described below in a 23° C./60% RH environment.

(1) The oscillation amplitude of the vibrating table was preliminarily adjusted to give 0.60 mm (peak-to-peak) for the displacement value on the digital-display vibrometer.
(2) The toner was first held for 24 hours in a 23° C./60% RH environment and 5 g of this toner was then accurately weighed out and gently placed on the 150 μm-aperture sieve that formed the uppermost stage.
(3) The sieves were vibrated for 15 seconds, after which the mass of the toner remaining on each sieve was measured and the degree of agglomeration was calculated based on the following formula.

degree of agglomeration (%)={(sample mass (g) on sieve *C*)/5 (g)}×100+{(sample mass (g) on sieve *B*)/5 (g)}×100×0.6+{(sample mass (g) on sieve *A*)/5 (g)}×100×0.2

Image-forming methods that can use the toner of the present invention are described in detail below. The toner of the present invention can be used in the heretofore known image-forming methods without particular limitation. Specific examples in this regard are nonmagnetic single-component contact development systems, magnetic single-component jumping development systems, two-component jumping development systems, and so forth.

EXAMPLES

The present invention is specifically described by the examples provided below. However, these in no way limit the present invention. Toners and methods of producing toner are described below. Unless specifically stated otherwise, "parts" and "%" in the examples and comparative examples are always on a mass basis.

<Polar Resin Production Examples>

Examples of polar resin production are provided below.

(Polar Resin 1)

300 mass parts of xylene (boiling point=144° C.) was introduced into an autoclave fitted with a pressure-reduction device, water-separation device, nitrogen gas introduction device, temperature measurement device, and stirring device; the interior of the container was thoroughly substituted with nitrogen while stirring; and the temperature was then raised and heating under reflux was carried out.

A mixed solution of

| | |
|---|---|
| styrene | 95.85 mass parts |
| methyl methacrylate | 2.50 mass parts |
| methacrylic acid | 1.65 mass parts |
| di-tert-butyl peroxide (polymerization initiator) | 2.00 mass parts |

was added while heating under reflux, after which polymerization was carried out for 5 hours at 0.150 MPa for the pressure during the reaction and 170° C. for the polymerization temperature. This was followed by removal of the xylene in a reduced-pressure solvent removal step for 3 hours and granulation to obtain a carboxyl group-containing vinyl resin as a polar resin 1. The properties of polar resin 1 are shown in Table 2.

(Polar Resins 2 to 17)

Polar resins 2 to 17 were synthesized proceeding as in the polar resin 1 production example, but changing the monomer composition, amount of polymerization initiator, reaction pressure, and reaction temperature in the polar resin 1 production example to that shown in Table 1. The properties of the carboxyl group-containing vinyl resins as polar resin 2 to polar resin 17 are shown in Table 2. When atmospheric pressure is given for the reaction pressure, this indicates that the synthesis was performed with the reaction system open while heating under reflux.

(Polar Resin 18)

The polyester monomer and catalyst indicated below were introduced into an autoclave fitted with a pressure-reduction device, water-separation device, nitrogen gas introduction device, temperature measurement device, and stirring device

| | |
|---|---|
| terephthalic acid | 24.00 mass parts |
| isophthalic acid | 24.00 mass parts |
| 2 mol adduct of propylene oxide on bisphenol A | 115.20 mass parts |
| 3 mol adduct of propylene oxide on bisphenol A | 12.80 mass parts |
| titanium potassium oxalate (catalyst) | 0.035 mass part |

and a reaction was run for 20 hours at 220° C. at normal pressure under a nitrogen atmosphere and for an additional 1 hour under a reduced pressure of 10 to 20 mmHg. The temperature was subsequently dropped to 170° C.; 0.15 mass part trimellitic anhydride was added; a reaction was run for 1.0 hour at 170° C.; the temperature was lowered; and pulverization was carried out to obtain a carboxyl group-containing polyester resin as a polar resin 18. The properties of polar resin 18 are shown in Table 2. Acid value of the polar resin 18 was 8.2 mgKOH/g.

(Polar Resin 19)

Polar resin 19 was obtained proceeding as in the polar resin 18 production example, but changing the monomer composition in the polar resin 18 production example to that shown below. The properties of polar resin 19 are shown in Table 2. Acid value of the polar resin 19 was 20.2 mgKOH/g.

| | |
|---|---|
| fumaric acid | 48.00 mass parts |
| 2 mol adduct of propylene oxide on bisphenol A | 64.00 mass parts |
| 3 mol adduct of propylene oxide on bisphenol A | 64.00 mass parts |
| titanium potassium oxalate (catalyst) | 0.035 mass part |

TABLE 1

| | monomer composition (mass parts) | | | | | | polymerization initiator | reaction pressure | reaction temperature |
|---|---|---|---|---|---|---|---|---|---|
| | St | MMA | MAA | a-MS | BA | DVB | (mass parts) | (MPa) | (° C.) |
| polar resin 1 | 95.85 | 2.50 | 1.65 | 0.00 | 0.00 | 0.00 | 2.00 | 0.150 | 170 |
| polar resin 2 | 85.85 | 2.50 | 1.65 | 10.00 | 0.00 | 0.00 | 2.00 | 0.150 | 170 |
| polar resin 3 | 94.60 | 2.50 | 1.65 | 0.00 | 1.25 | 0.00 | 2.00 | 0.150 | 170 |
| polar resin 4 | 75.85 | 2.50 | 1.65 | 20.00 | 0.00 | 0.00 | 2.00 | 0.150 | 170 |
| polar resin 5 | 93.35 | 2.50 | 1.65 | 0.00 | 2.50 | 0.00 | 2.00 | 0.150 | 170 |
| polar resin 6 | 92.75 | 2.50 | 1.65 | 0.00 | 3.00 | 0.10 | 1.50 | 0.150 | 170 |
| polar resin 7 | 93.35 | 2.50 | 1.65 | 2.50 | 0.00 | 0.00 | 3.00 | 0.150 | 170 |
| polar resin 8 | 92.25 | 2.50 | 1.65 | 0.00 | 3.50 | 0.10 | 1.00 | 0.150 | 170 |
| polar resin 9 | 90.85 | 2.50 | 1.65 | 5.00 | 0.00 | 0.00 | 3.50 | 0.150 | 170 |
| polar resin 10 | 95.85 | 2.50 | 1.65 | 0.00 | 0.00 | 0.00 | 1.50 | 0.300 | 210 |
| polar resin 11 | 95.85 | 2.50 | 1.65 | 0.00 | 0.00 | 0.00 | 2.10 | 0.125 | 150 |
| polar resin 12 | 95.85 | 2.50 | 1.65 | 0.00 | 0.00 | 0.00 | 1.20 | 0.350 | 220 |
| polar resin 13 | 95.85 | 2.50 | 1.65 | 0.00 | 0.00 | 0.00 | 2.20 | atmospheric pressure | 140 |
| polar resin 14 | 21.50 | 70.00 | 1.50 | 0.00 | 7.00 | 0.00 | 2.20 | atmospheric pressure | 140 |
| polar resin 15 | 94.20 | 2.50 | 3.30 | 0.00 | 2.50 | 0.00 | 2.00 | 0.15 | 170 |
| polar resin 16 | 92.55 | 2.50 | 4.95 | 0.00 | 3.75 | 0.00 | 2.00 | 0.15 | 170 |
| polar resin 17 | 96.84 | 2.50 | 0.66 | 0.00 | 0.00 | 0.00 | 2.00 | 0.15 | 170 |
| polar resin 18 | polyester resin | | | | | | | | |
| polar resin 19 | polyester resin | | | | | | | | |

The following abbreviations are used for the monomer composition:

St = styrene,

MMA = methyl methacrylate,

MAA = methacrylic acid,

α-MS = α-methylstyrene,

BA = butyl acrylate, and

DVB = divinylbenzene.

TABLE 2

| | Tg (° C.) | Mw | Mn | Mp | α (mgKOH/g) | α/β | interfacial tension (mN/m) |
|---|---|---|---|---|---|---|---|
| polar resin 1 | 89 | 12800 | 6000 | 15200 | 10.5 | 1.02 | 34.1 |
| polar resin 2 | 93 | 13200 | 6200 | 15400 | 10.1 | 0.99 | 33.7 |
| polar resin 3 | 86 | 13200 | 6100 | 15300 | 9.9 | 0.96 | 34.3 |
| polar resin 4 | 96 | 13100 | 5900 | 15300 | 10.1 | 0.98 | 33.5 |
| polar resin 5 | 83 | 12800 | 5800 | 15200 | 10.0 | 0.97 | 34.5 |
| polar resin 6 | 89 | 43600 | 10400 | 25300 | 10.4 | 1.01 | 34.7 |
| polar resin 7 | 89 | 11000 | 4500 | 10800 | 10.3 | 1.00 | 34.0 |
| polar resin 8 | 89 | 55200 | 14100 | 34800 | 10.2 | 1.00 | 34.8 |
| polar resin 9 | 87 | 9200 | 3800 | 9000 | 10.0 | 0.98 | 33.9 |
| polar resin 10 | 89 | 13100 | 6100 | 14900 | 11.9 | 1.17 | 34.1 |
| polar resin 11 | 89 | 13400 | 6200 | 15200 | 8.3 | 0.82 | 34.1 |
| polar resin 12 | 89 | 12600 | 5900 | 15200 | 12.8 | 1.25 | 34.1 |
| polar resin 13 | 89 | 13600 | 6100 | 15200 | 7.8 | 0.76 | 34.1 |
| polar resin 14 | 76 | 11200 | 4500 | 11000 | 7.1 | 0.78 | 30.5 |
| polar resin 15 | 95 | 14400 | 6000 | 15800 | 20.2 | 1.01 | 27.4 |
| polar resin 16 | 93 | 15600 | 6200 | 15700 | 30.4 | 0.99 | 22.3 |
| polar resin 17 | 88 | 12500 | 6000 | 15300 | 4.1 | 1.02 | 35.7 |
| polar resin 18 | 75 | 9500 | 4000 | 9400 | — | — | 26.3 |
| polar resin 19 | 77 | 12500 | 6200 | 12800 | — | — | 28.5 |

<Wax Production Examples>

Examples of wax production are given in the following.

(Wax 1)

300 mass parts of toluene was introduced into a 1-liter three-neck roundbottom flask fitted with a stirrer, thermometer, and reflux condenser and was heated under reflux at 120° C.

| | |
|---|---|
| behenic acid | 100.0 mass parts |
| behenyl alcohol | 96.0 mass parts |
| p-toluenesulfonic acid | 0.5 mass part |

The substances listed above were added while heating under reflux and an esterification reaction was run at 120° C. for 6 hours. The water produced during this time was removed from the system using the toluene/water azeotrope. After the completion of the reaction, the p-toluenesulfonic acid was neutralized using sodium bicarbonate. The obtained solution was subjected to evaporation to remove the toluene. After heating the product to 90° C., Celite filtration was performed to remove the sodium p-toluenesulfonate, thereby yielding wax 1. The melting point of wax 1 and its half width of an endothermic peak are given in Table 3.

(Waxes 2 to 4 and Waxes 6 to 8)

Waxes 2 to 4 and waxes 6 to 8 were synthesized proceeding as in the wax 1 production example, but changing the substances used in the wax 1 production example to those given in Table 1. The melting points and half widths of endothermic peak of the obtained waxes 2 to 4 and waxes 6 to 8 are given in Table 3.

(Wax 5)

A commercial oleamide wax (Neutron-P from Nippon Fine Chemical Co., Ltd.) was used as wax 5. The melting point and half width of an endothermic peak of wax 5 are given in Table 3.

(Wax 9)

A commercial Fischer-Tropsch wax (HNP-10 from Nippon Seiro Co., Ltd.) was used as wax 9. The melting point and endothermic peak half width of wax 9 are given in Table 3.

TABLE 3

| | | carboxylic acid | | alcohol | | | |
|---|---|---|---|---|---|---|---|
| | type of wax | compound name | amount of addition (mass parts) | compound name | amount of addition (mass parts) | melting point (° C.) | endothermic peak half width (° C.) |
| wax 1 | behenyl behenate | behenic acid | 100.0 | behenyl alcohol | 96.0 | 72 | 2.4 |
| wax 2 | dibehenyl dodecanedioate | dodecanedioic acid | 100.0 | behenyl alcohol | 192.0 | 78 | 2.6 |
| wax 3 | distearyl adipate | adipic acid | 100.0 | stearyl alcohol | 192.0 | 65 | 2.2 |
| wax 4 | behenyl behenate | behenic acid | 100.0 | behenyl alcohol | 104.0 | 71 | 3.7 |
| wax 5 | oleamide | — | — | — | — | 73 | 2.8 |
| wax 6 | butanediol dibehenate | behenic acid | 100.0 | butanediol | 48.0 | 81 | 2.8 |
| wax 7 | stearyl stearate | stearic acid | 100.0 | stearyl alcohol | 96.0 | 61 | 1.6 |
| wax 8 | glyceryl tribehenate | behenic acid | 100.0 | glycerol | 32.0 | 67 | 4.1 |
| wax 9 | Fischer-Tropsch wax | — | — | — | — | 75 | 4.3 |

(Example of the Production of a Colorant-Dispersed Solution)

The following materials were mixed and then stirred for 3 hours at 200 rpm with zirconia beads (3/16 inch) using an attritor (Mitsui Mining Co., Ltd.). A colorant-dispersed solution was then obtained by removing the beads.

| | |
|---|---|
| styrene | 36.0 mass parts |
| colorant, C.I. Pigment Blue 15:3 | 6.0 mass parts |

<Toner Production Examples>

(Toner 1)

A suspension-polymerized toner was produced by the following method.

| | |
|---|---|
| styrene | 34.0 mass parts |
| n-butyl acrylate | 30.0 mass parts |
| polar resin 1 | 15.0 mass parts |
| polar resin 15 | 5.0 mass parts |
| charge control agent, Bontron E-88 from Orient Chemical Industries Co., Ltd. | 1.0 mass part |

These substances were mixed and were stirred for 2 hours to dissolve the polar resins and obtain a polar resin-containing monomer composition.

| | |
|---|---|
| the polar resin-containing monomer composition | 85.0 mass parts |
| the colorant-dispersed solution | 42.0 mass parts |

These substances were mixed. The mixture was then heated to 60° C. and 10.0 mass parts of wax 1 was added. 5.0 mass parts of the polymerization initiator Perbutyl O (NOF Corporation) was added and stirring was carried out for 5 minutes.

Separately, 850 mass parts of an aqueous 0.1 mol/L $Na_3PO_4$ solution and 8.0 mass parts 10% hydrochloric acid were added to a container equipped with a CLEARMIX (M Technique Co., Ltd.) high-speed stirrer. The rotation was adjusted to 15,000 rpm and heating was carried out to 60° C. To this was added 68 mass parts of an aqueous 1.0 mol/L $CaCl_2$ solution to prepare an aqueous medium that contained the sparingly water-soluble dispersing agent $Ca_3(PO_4)_2$ in a finely divided form. After the above-described polymerization initiator had been introduced into the polymerizable monomer composition and 5 minutes had then been allowed to elapse, the polymerizable monomer composition residing at 60° C. was subsequently introduced into the aqueous medium, which had been heated to a temperature of 60° C., and granulation was carried out for 15 minutes while rotating the CLEARMIX at 15,000 rpm. Then, the stirrer was changed from the high-speed stirrer to a propeller stirring blade; a reaction was run for 5 hours at 60° C. while refluxing; the liquid temperature was brought to 80° C.; and the reaction was run for an additional 5 hours. After the completion of polymerization, the liquid temperature was brought down to about 20° C. and the pH of the aqueous medium was brought to 3.0 or less by the addition of dilute hydrochloric acid and the sparingly water-soluble dispersing agent was dissolved. Washing and drying then yielded toner particles.

To 100.0 mass parts of the toner particles was subsequently added a flowability improver in the form of 2.0 mass parts of a hydrophobically treated fine silica powder (number-average particle diameter of the primary particles=10 nm, BET specific surface area=170 $m^2/g$) that was treated with a dimethylsilicone oil (20 mass %) and tribocharges to the same polarity (negative polarity) as the toner particles. Mixing for 15 minutes at 300 rpm using a Henschel mixer (Mitsui Mining Co., Ltd.) then gave a toner 1. Table 4 gives the monomer composition, the type and number of parts of addition and difference in interfacial tension (Xa−Xb) for the polar resin, type of wax and number of parts of wax addition, and number of parts of polymerization initiator addition for toner 1, while Table 5 gives the property values for toner 1. In Table 4, St denotes styrene and BA denotes n-butyl acrylate.

(Toner 2 to Toner 20 and Toner 23 to Toner 34)

Toner 2 to toner 20 and toner 23 to toner 34 were produced proceeding as in the toner 1 production example, but changing the monomer composition, type and number of parts of addition and difference in interfacial tension (Xa−Xb) for the polar resin, type of wax and number of parts of wax addition, and number of parts of polymerization initiator addition to that given in Table 4. The properties of toner 2 to toner 20 and toner 23 to toner 34 are given in Table 5.

(Toner 21)

A solution-suspension toner was produced by the following method.

(Example of the Production of a Wax Dispersing Agent)

| | |
|---|---|
| xylene | 300.0 mass parts |
| wax 1 | 100.0 mass parts |

were introduced into an autoclave fitted with a thermometer and stirrer and the temperature was raised to 150° C. under a nitrogen atmosphere.

A mixed solution of

| | |
|---|---|
| styrene | 100.0 mass parts |
| acrylonitrile | 84.0 mass parts |
| monobutyl maleate | 120.0 mass parts |
| di-t-butylperoxy hexahydroterephthalate | 5.0 mass parts |
| xylene | 200.0 mass parts |

was added dropwise over 3 hours and a polymerization was carried out by holding for an additional 60 minutes at 150° C. This was introduced into 2000 mass parts of methanol, followed by filtration and drying to obtain a wax dispersing agent.

(Example of the Production of a Wax-Dispersed Solution)

100.0 mass parts of wax 1, which had been ground to an average particle diameter of 20 μm, was introduced into 100.0 mass parts of methanol and was washed by stirring for 10 minutes at a rotation rate of 150 rpm; this was followed by filtration. This process was carried out three times, after which the wax was recovered by filtration and drying.

90.0 mass parts of the obtained wax, 10.0 mass parts of the above-described wax dispersing agent, and 100.0 mass parts of ethyl acetate were introduced into an attritor (Mitsui Mining Co., Ltd.) that had been loaded with 20 mm-diameter zirconia beads. Dispersion was performed for 2 hours at 150 rpm. The zirconia beads were separated to yield a wax-dispersed solution.

(Example of the Production of a Colorant-Dispersed Solution)

20.0 mass parts of C. I. Pigment Blue colorant and 80.0 mass parts of ethyl acetate were introduced into an attritor (Mitsui Mining Co., Ltd.) that had been loaded with zirconia beads (3/16 inch), and rotation was carried out for 8 hours at a rotation rate of 300 rpm. The zirconia beads were separated to obtain the colorant-dispersed solution.

(Toner Production Example)

The following were mixed to homogeneity to form a toner composition.

| | |
|---|---|
| styrene-n-butyl acrylate copolymer binder resin (styrene-n-butyl acrylate copolymerization ratio = 70.0:30.0, Mp = 22,000, Mw = 35,000, Mw/Mn = 2.4, Tg = 51° C.) | 100.0 mass parts |
| polar resin 13 | 15.0 mass parts |
| polar resin 15 | 5.0 mass parts |
| wax-dispersed solution | 20.0 mass parts |
| colorant-dispersed solution | 30.0 mass parts |
| charge control agent, Bontron E-88 from Orient Chemical Industries Co., Ltd. | 1.0 mass part |

Separately, 850 mass parts of an aqueous 0.1 mol/L $Na_3PO_4$ solution and 8.0 mass parts of 10% hydrochloric acid were added to a container equipped with a CLEARMIX (M Technique Co., Ltd.) high-speed stirrer. The rotation was adjusted to 15,000 rpm and heating was carried out to 60° C. To this was added 68 mass parts of an aqueous 1.0 mol/L $CaCl_2$ solution to prepare an aqueous medium that contained the sparingly water-soluble dispersing agent $Ca_3(PO_4)_2$ in a finely divided form.

While maintaining the aqueous medium at 30 to 35° C. and the rotation rate at 15,000 rpm, the above-described toner composition was introduced into the aqueous medium and granulation was performed for 2 minutes. This was followed by the introduction of 500 mass parts of ion-exchanged water. The stirrer was changed to an ordinary propeller stirrer; the aqueous medium was held at 30 to 35° C. and the stirrer rpm was brought to 150 rpm; and the pressure in the interior of the container was reduced to 52 kPa and distillation was carried out until the residual ethyl acetate level reached 200 ppm.

The aqueous medium was then heated to 80° C. and was heat-treated for 30 minutes at 80° C. It was cooled to 25° C. at a cooling rate of 0.15° C./minute. While maintaining the internal temperature at 20.0 to 25.0° C., dilute hydrochloric acid was added to the aqueous dispersion medium and the sparingly water-soluble dispersing agent was dissolved. Washing and drying then yielded toner particles. A toner 21 was obtained by the addition to the obtained toner particles of a flowability improver as in the toner 1 production example.

(Toner 22)

An emulsion-aggregation toner was produced by the following method.

(Production of a Fine Resin Particle-Dispersed Solution)

The following materials were mixed in a flask to prepare an aqueous medium.

| | |
|---|---|
| ion-exchanged water | 500.0 mass parts |
| nonionic surfactant, Nonipol 400 (Kao Corporation) | 6.0 mass parts |
| anionic surfactant, Neogen SC (Dai-ichi Kogyo Seiyaku Co., Ltd.) | 10.0 mass parts |

In addition, the following materials were mixed to obtain a mixed solution.

| | |
|---|---|
| styrene | 70.0 mass parts |
| n-butyl acrylate | 30.0 mass parts |
| charge control agent, Bontron E-88 from Orient Chemical Industries Co., Ltd. | 1.0 mass part |

This mixed solution was dispersed/emulsified in the above-described aqueous medium and 50 mass parts of an ion-exchanged water solution in which 4 mass parts ammonium persulfate was dissolved as the polymerization initiator was introduced while slowly stirring/mixing for 10 minutes. The interior of the system was then thoroughly substituted with nitrogen; the interior of the system was heated to a temperature of 70° C. on an oil bath while the flask was stirred; and emulsion polymerization was continued in this state for 5 hours. This yielded an anionic fine resin particle-dispersed solution.

(Production of a Colorant Particle-Dispersed Solution)

| | |
|---|---|
| ion-exchanged water | 100.0 mass parts |
| colorant, C.I. Pigment Blue 15:3 | 6.0 mass parts |
| nonionic surfactant, Nonipol 400 (Kao Corporation) | 1.0 mass part |

The above-described components were mixed and dissolved and were dispersed for 10 minutes using an Ultra-Turrax T50 from IKA to provide a colorant particle-dispersed solution.

(Production of a Wax Particle-Dispersed Solution)

| | |
|---|---|
| ion-exchanged water | 100.0 mass parts |
| wax 1 | 10.0 mass parts |
| cationic surfactant, Sanisol B50 (Kao Corporation) | 5.0 mass parts |

The above-described components were heated to a temperature of 95° C. and were thoroughly dispersed using an Ultra-Turrax T50. This was followed by a dispersion treatment with a pressure-ejection homogenizer to provide a wax particle-dispersed solution.

(Production of a Fine Particle-Dispersed Solution 1 for Shell Formation)

| | |
|---|---|
| ion-exchanged water | 100.0 mass parts |
| ethyl acetate | 50.0 mass parts |
| polar resin 13 | 15.0 mass parts |

The above-described components were mixed and stirred. While this solution was being emulsified with an Ultra-Turrax T50, it was heated to a temperature of 80° C. and solvent removal was performed by holding for 6 hours, thus yielding a fine particle-dispersed solution for shell formation.

(Production of a Fine Particle-Dispersed Solution 2 for Shell Formation)

| | |
|---|---|
| ion-exchanged water | 100.0 mass parts |
| ethyl acetate | 50.0 mass parts |
| polar resin 15 | 5.0 mass parts |

The above-described components were mixed and stirred. While this solution was being emulsified with an Ultra-Turrax T50, it was heated to a temperature of 80° C. and solvent removal was performed by holding for 6 hours, thus yielding a fine particle-dispersed solution for shell formation.

(Toner Particle Production)

The above-described fine resin particle-dispersed solution, colorant particle-dispersed solution, wax particle-dispersed solution, and 1.2 mass parts polyaluminum chloride were mixed and were thoroughly mixed/dispersed in a round stainless steel flask using an Ultra-Turrax T50. This was followed by heating to a temperature of 51° C. on a heating oil bath while the flask was stirred. After holding for 60 minutes at a temperature of 51° C., the above-described fine particle-dispersed solution 1 for shell formation and fine particle-dispersed solution 2 for shell formation were added. The pH of the system was subsequently adjusted to 6.5 using an aqueous sodium hydroxide solution having a concentration of 0.5 mol/L; the stainless steel flask was then closed and sealed and the stirrer shaft was magnetically sealed; and heating to a temperature of 97° C. was performed while continuing to stir and holding was carried out for 6 hours.

After the completion of the reaction, cooling, filtration, and thorough washing with ion-exchanged water were performed and solid/liquid separation was then carried out using suction filtration across a nutsch filter. This was redispersed using an additional 3 L of ion-exchanged water at a temperature of 40° C., and stirring/washing was performed at 300 rpm for 15 minutes. This washing process was repeated 5 times more. Solid/liquid separation was subsequently carried out using No. 5A filter paper by suction filtration across a nutsch filter. Vacuum drying was then continued for 12 hours to obtain toner particles. Toner 22 was obtained by the addition to the obtained toner particles of a flowability improver as in the toner 1 production example.

TABLE 4

| | monomer composition | | polar resin | | | | | wax | | polymerization |
|---|---|---|---|---|---|---|---|---|---|---|
| | St | BA | type | no. of parts of addition | type | no. of parts of addition | Xa − Xb | type | no. of parts of addition | initiator no. of parts of addition |
| Toner 1 | 70.0 | 30.0 | polar resin 1 | 15.0 | polar resin18 | 5.0 | 7.8 | wax 1 | 10.0 | 5.0 |
| Toner 2 | 75.0 | 25.0 | polar resin 1 | 15.0 | polar resin18 | 5.0 | 7.8 | wax 2 | 10.0 | 5.0 |
| Toner 3 | 65.0 | 35.0 | polar resin 1 | 15.0 | polar resin18 | 5.0 | 7.8 | wax 3 | 10.0 | 5.0 |
| Toner 4 | 70.0 | 30.0 | polar resin 1 | 15.0 | polar resin18 | 5.0 | 7.8 | wax 1 | 10.0 | 3.0 |
| Toner 5 | 70.0 | 30.0 | polar resin 1 | 15.0 | polar resin18 | 5.0 | 7.8 | wax 1 | 10.0 | 8.0 |
| Toner 6 | 70.0 | 30.0 | polar resin 1 | 5.0 | polar resin18 | 5.0 | 7.8 | wax 1 | 10.0 | 5.0 |
| Toner 7 | 70.0 | 30.0 | polar resin 1 | 15.0 | polar resin18 | 5.0 | 7.8 | wax 4 | 10.0 | 5.0 |
| Toner 8 | 70.0 | 30.0 | polar resin 2 | 15.0 | polar resin18 | 5.0 | 7.4 | wax 1 | 10.0 | 5.0 |
| Toner 9 | 70.0 | 30.0 | polar resin 3 | 15.0 | polar resin18 | 5.0 | 8.0 | wax 4 | 10.0 | 5.0 |
| Toner 10 | 70.0 | 30.0 | polar resin 4 | 15.0 | polar resin18 | 5.0 | 7.2 | wax 1 | 10.0 | 5.0 |
| Toner 11 | 70.0 | 30.0 | polar resin 5 | 15.0 | polar resin18 | 5.0 | 8.2 | wax 1 | 10.0 | 5.0 |
| Toner 12 | 70.0 | 30.0 | polar resin 6 | 15.0 | polar resin18 | 5.0 | 8.4 | wax 1 | 10.0 | 5.0 |
| Toner 13 | 70.0 | 30.0 | polar resin 7 | 15.0 | polar resin18 | 5.0 | 7.7 | wax 1 | 10.0 | 5.0 |
| Toner 14 | 70.0 | 30.0 | polar resin 8 | 15.0 | polar resin18 | 5.0 | 8.5 | wax 1 | 10.0 | 5.0 |
| Toner 15 | 70.0 | 30.0 | polar resin 9 | 15.0 | polar resin18 | 5.0 | 7.6 | wax 1 | 10.0 | 5.0 |
| Toner 16 | 70.0 | 30.0 | polar resin 10 | 15.0 | polar resin18 | 5.0 | 7.8 | wax 1 | 10.0 | 5.0 |
| Toner 17 | 70.0 | 30.0 | polar resin 11 | 15.0 | polar resin18 | 5.0 | 7.8 | wax 1 | 10.0 | 5.0 |
| Toner 18 | 70.0 | 30.0 | polar resin 12 | 15.0 | polar resin18 | 5.0 | 7.8 | wax 1 | 10.0 | 5.0 |
| Toner 19 | 70.0 | 30.0 | polar resin 13 | 15.0 | polar resin18 | 5.0 | 7.8 | wax 1 | 10.0 | 5.0 |
| Toner 20 | 73.0 | 27.0 | polar resin 1 | 15.0 | polar resin18 | 5.0 | 7.8 | wax 5 | 10.0 | 5.0 |
| Toner 21 | 70.0 | 30.0 | polar resin 13 | 15.0 | polar resin18 | 5.0 | 7.8 | wax 1 | 10.0 | — |
| Toner 22 | 70.0 | 30.0 | polar resin 13 | 15.0 | polar resin18 | 5.0 | 7.8 | wax 1 | 10.0 | 4.0 |
| Toner 23 | 70.0 | 30.0 | polar resin15 | 15.0 | polar resin18 | 5.0 | 1.1 | wax 1 | 10.0 | 5.0 |
| Toner 24 | 70.0 | 30.0 | polar resin19 | 15.0 | polar resin18 | 5.0 | −4.0 | wax 1 | 10.0 | 5.0 |
| Toner 25 | 70.0 | 30.0 | polar resin17 | 15.0 | polar resin18 | 5.0 | 9.4 | wax 1 | 10.0 | 5.0 |
| Toner 26 | 70.0 | 30.0 | polar resin 16 | 15.0 | polar resin18 | 5.0 | — | wax 1 | 10.0 | 5.0 |
| Toner 27 | 70.0 | 30.0 | polar resin 1 | 15.0 | polar resin 14 | 5.0 | — | wax 1 | 10.0 | 5.0 |
| Toner 28 | 78.0 | 22.0 | polar resin 13 | 15.0 | polar resin18 | 5.0 | 7.8 | wax 6 | 10.0 | 5.0 |
| Toner 29 | 62.0 | 38.0 | polar resin 13 | 15.0 | polar resin18 | 5.0 | 7.8 | wax 7 | 10.0 | 5.0 |

TABLE 4-continued

| | monomer composition | | polar resin | | | | | wax | | polymerization |
|---|---|---|---|---|---|---|---|---|---|---|
| | | | | no. of parts of | | no. of parts of | | | no. of parts of | initiator no. of parts of |
| | St | BA | type | addition | type | addition | Xa − Xb | type | addition | addition |
| Toner 30 | 70.0 | 30.0 | polar resin 13 | 15.0 | polar resin18 | 5.0 | 7.8 | wax 1 | 10.0 | 1.0 |
| Toner 31 | 70.0 | 30.0 | polar resin 13 | 15.0 | polar resin18 | 5.0 | 7.8 | wax 1 | 10.0 | 10.0 |
| Toner 32 | 70.0 | 30.0 | — | — | polar resin18 | 5.0 | — | wax 1 | 10.0 | 5.0 |
| Toner 33 | 70.0 | 30.0 | polar resin 13 | 15.0 | polar resin18 | 5.0 | 7.8 | wax 8 | 10.0 | 5.0 |
| Toner 34 | 70.0 | 30.0 | polar resin 13 | 15.0 | polar resin18 | 5.0 | 7.8 | wax 9 | 10.0 | 5.0 |

TABLE 5

| | Tp (° C.) | $G^2$(Tp) (Pa) | $G^2$(Tp + 15) (Pa) | $G^2$(Tp + 30) (Pa) | $G^2$(Tp)/$G^2$ (Tp + 15) | $G^2$(Tp + 15)/$G^2$(Tp + 30) |
|---|---|---|---|---|---|---|
| Toner 1 | 46 | $1.58 \times 10^8$ | $5.53 \times 10^7$ | $5.50 \times 10^5$ | 2.86 | 100.55 |
| Toner 2 | 54 | $1.67 \times 10^8$ | $5.74 \times 10^7$ | $5.69 \times 10^5$ | 2.91 | 100.80 |
| Toner 3 | 41 | $1.50 \times 10^8$ | $5.32 \times 10^7$ | $5.34 \times 10^5$ | 2.82 | 99.52 |
| Toner 4 | 46 | $2.82 \times 10^8$ | $9.79 \times 10^7$ | $9.74 \times 10^5$ | 2.88 | 100.55 |
| Toner 5 | 46 | $9.21 \times 10^7$ | $3.15 \times 10^7$ | $3.13 \times 10^5$ | 2.93 | 100.55 |
| Toner 6 | 44 | $1.42 \times 10^8$ | $2.48 \times 10^7$ | $2.53 \times 10^5$ | 5.72 | 98.20 |
| Toner 7 | 46 | $1.55 \times 10^8$ | $5.00 \times 10^7$ | $9.31 \times 10^5$ | 3.10 | 53.70 |
| Toner 8 | 47 | $1.65 \times 10^8$ | $7.69 \times 10^7$ | $6.84 \times 10^5$ | 2.15 | 112.40 |
| Toner 9 | 45 | $1.31 \times 10^8$ | $2.31 \times 10^7$ | $4.10 \times 10^5$ | 5.68 | 56.20 |
| Toner 10 | 48 | $1.58 \times 10^8$ | $1.12 \times 10^7$ | $1.09 \times 10^6$ | 1.41 | 102.38 |
| Toner 11 | 44 | $1.03 \times 10^8$ | $1.84 \times 10^7$ | $1.79 \times 10^5$ | 5.58 | 102.78 |
| Toner 12 | 46 | $1.67 \times 10^8$ | $5.72 \times 10^7$ | $5.32 \times 10^5$ | 2.92 | 107.50 |
| Toner 13 | 46 | $1.44 \times 10^8$ | $5.16 \times 10^7$ | $5.40 \times 10^5$ | 2.79 | 95.60 |
| Toner 14 | 46 | $1.75 \times 10^8$ | $5.87 \times 10^7$ | $5.79 \times 10^5$ | 2.98 | 101.41 |
| Toner 15 | 46 | $1.36 \times 10^8$ | $5.07 \times 10^7$ | $5.12 \times 10^5$ | 2.68 | 99.11 |
| Toner 16 | 46 | $1.60 \times 10^8$ | $5.55 \times 10^7$ | $5.48 \times 10^5$ | 2.88 | 101.28 |
| Toner 17 | 46 | $1.55 \times 10^8$ | $5.49 \times 10^7$ | $5.55 \times 10^5$ | 2.82 | 98.92 |
| Toner 18 | 46 | $1.57 \times 10^8$ | $5.55 \times 10^7$ | $5.59 \times 10^5$ | 2.83 | 99.28 |
| Toner 19 | 46 | $1.58 \times 10^8$ | $5.62 \times 10^7$ | $5.60 \times 10^5$ | 2.81 | 100.36 |
| Toner 20 | 46 | $1.25 \times 10^8$ | $2.52 \times 10^7$ | $2.48 \times 10^5$ | 4.96 | 101.61 |
| Toner 21 | 46 | $1.60 \times 10^8$ | $5.46 \times 10^7$ | $5.50 \times 10^5$ | 2.93 | 99.27 |
| Toner 22 | 46 | $1.22 \times 10^8$ | $3.75 \times 10^7$ | $3.57 \times 10^5$ | 3.25 | 105.16 |
| Toner 23 | 46 | $1.55 \times 10^8$ | $6.53 \times 10^7$ | $5.50 \times 10^5$ | 2.37 | 118.73 |
| Toner 24 | 46 | $1.63 \times 10^8$ | $7.70 \times 10^7$ | $6.89 \times 10^5$ | 2.12 | 111.76 |
| Toner 25 | 46 | $1.52 \times 10^8$ | $5.26 \times 10^7$ | $5.30 \times 10^5$ | 2.89 | 99.25 |
| Toner 26 | 46 | $1.88 \times 10^8$ | $3.35 \times 10^7$ | $3.29 \times 10^5$ | 5.61 | 101.68 |
| Toner 27 | 46 | $1.45 \times 10^8$ | $4.42 \times 10^7$ | $5.48 \times 10^5$ | 3.28 | 80.66 |
| Toner 28 | 56 | $1.72 \times 10^8$ | $5.77 \times 10^7$ | $5.68 \times 10^5$ | 2.98 | 101.61 |
| Toner 29 | 39 | $1.44 \times 10^8$ | $5.23 \times 10^7$ | $5.36 \times 10^5$ | 2.75 | 97.57 |
| Toner 30 | 46 | $3.12 \times 10^8$ | $9.63 \times 10^7$ | $9.40 \times 10^5$ | 3.24 | 102.40 |
| Toner 31 | 46 | $7.82 \times 10^7$ | $2.93 \times 10^7$ | $2.98 \times 10^5$ | 2.67 | 98.40 |
| Toner 32 | 43 | $1.32 \times 10^8$ | $2.16 \times 10^7$ | $2.20 \times 10^5$ | 6.12 | 98.20 |
| Toner 33 | 46 | $1.52 \times 10^8$ | $5.42 \times 10^7$ | $1.23 \times 10^6$ | 2.80 | 44.10 |
| Toner 34 | 49 | $1.48 \times 10^8$ | $2.16 \times 10^7$ | $5.30 \times 10^5$ | 6.86 | 40.68 |

Examples 1 to 27 and Comparative Examples 1 to 7

The evaluations described below were performed using the above-described toner 1 to toner 34. The results are given in Table 6.

The evaluation methods and evaluation scales used in the present invention are described in the following.

A modified version of an LBP-5400, which is a laser printer from Canon available on the market, was used as the image-forming apparatus.

The modifications in this test machine are as follows.

(1) The process speed was brought to 240 mm/sec by modifying the gearing and software in the test machine itself.

(2) The cyan cartridge was used as the cartridge used for the evaluations. Namely, the product toner was removed from a commercial cyan cartridge; the interior was cleaned with an air blower; 200 g of the above-described toner was loaded; and the evaluation was performed. The product toner was removed at each of the stations for yellow, magenta, and black; the yellow, magenta, and black cartridges were installed after the remaining toner detection mechanisms had been rendered inoperable; and the evaluation was performed.

(3) The software was modified so the heating temperature at the fixing unit could be controlled to 190° C.±20° C.

(4) The cooling fan was stopped by modifying the software.

[1] Storage Stability

A thermostat set to one of the temperatures between from 50.0° C. to 60.0° C. on an interval of 2.5° C. was prepared and 5.0 g of the toner, weighed into a 100 mL plastic cup, was placed in the thermostat and was held there for 72 hours. The degree of agglomeration was then measured by the method described above, and the evaluation was carried out using the temperature at which the degree of agglomeration became less than or equal to 10(%) for the heat-resistant temperature of the toner.

Evaluation Scale

A: The heat-resistant temperature is greater than or equal to 60.0° C.

B: The heat-resistant temperature is greater than or equal to 57.5° C. and less than 60.0° C.

C: The heat-resistant temperature is greater than or equal to 55.0° C. and less than 57.5° C.

D: The heat-resistant temperature is less than 55.0° C.

[2] Cleaning Performance

The toner-loaded process cartridge and paper for Canon color laser copiers (81.4 g/m$^2$) was held for 72 hours in a normal temperature, normal humidity (N/N) environment (23° C./50% RH) or a high temperature environment (50° C./10% RH). The toner-loaded process cartridge and paper for Canon color laser copiers was subsequently transferred to a high temperature, high humidity environment (32.5° C./80% RH) and held for 24 hours. Density detection correction was then performed in the high temperature, high humidity environment. 2000 prints of an image with a 1% print percentage were thereafter output. The cleaning performance was then evaluated during the continuous output of 15 prints of a solid image having a toner laid-on level of 0.45 (mg/cm$^2$). This was followed by continuous output up to a total print output of 6000 prints. The above-described paper for Canon color laser copiers (81.4 g/m$^2$) was used for the output. After this output of 6000 prints, the cleaning performance was evaluated in the same manner as above.

Evaluation Scale

A: Vertical streaks due to cleaning blade slippage were completely absent during the continuous output of the 15 solid image prints.

B: Slight vertical streaking due to cleaning blade slippage is observed in the 11th to 15th solid image print.

C: Slight vertical streaking due to cleaning blade slippage is observed in the 6th to 10th solid image print.

D: Slight vertical streaking due to cleaning blade slippage is observed in the 1st to 5th solid image print.

[3] Low-Temperature Fixability

[3-1] Rubbing Test

The toner-loaded process cartridge is held for 48 hours in a normal temperature, normal humidity environment (23° C./50% RH). After this, an unfixed image is output of an image pattern in which a 10 mm×10 mm square image is uniformly 9-point arrayed over the entire transfer paper. The fixing starting temperature was evaluated using 0.45 (mg/cm$^2$) for the toner laid-on level on the transfer paper. Fox River Bond (90 g/m$^2$) was used for the transfer paper. For the fixing unit, the fixing unit was taken out of an LBP-5400 (Canon) and an external fixing unit was used that had been adapted to also operate outside the laser printer. The fixation temperature was freely settable at the external fixing unit, and the measurement was performed at a fixing condition of 240 mm/sec for the process speed.

To assess the start of fixing, the fixed image (also including cold-offset images) was rubbed with lens-cleaning paper (DASPER® Lenz Cleaning Paper from Ozu Paper Co., Ltd.) under a load of 50 g/cm$^2$, and the fixing starting point was defined as the temperature at which the decline in the density pre-versus-post-rubbing became less than 20%. The assessment scale is given below.

A: The fixing starting point is less than or equal to 150° C.

B: The fixing starting point is greater than 150° C. and less than or equal to 170° C.

C: The fixing starting point is greater than 170° C. and less than or equal to 190° C.

D: The fixing starting point is greater than 190° C.

[3-2] Blistering

An unfixed image was output proceeding as in the rubbing test evaluation method, but changing the toner laid-on level on the transfer paper in the rubbing test evaluation method to 0.90 (mg/cm$^2$). Fixing was thereafter carried out using the same conditions as in the rubbing test and the fixing start temperature was evaluated.

In the assessment of the start of fixing, the fixing starting point was defined as the temperature at which blister-like image delamination was not produced in the square image in the center of the paper.

Evaluation Scale

A: The fixing starting point is less than or equal to 150° C.

B: The fixing starting point is greater than 150° C. and less than or equal to 170° C.

C: The fixing starting point is greater than 170° C. and less than or equal to 190° C.

D: The fixing starting point is greater than 190° C.

[3-3] Resistance to Wraparound at High Temperature

For the resistance to wraparound at high temperature, an evaluation of fixing was performed under the same conditions as for the rubbing test, but changing the transfer paper in the rubbing test evaluation method to PB PAPER GF-500 (64 g/m$^2$).

The maximum temperature at which the paper could travel through without wraparound was used as the temperature for evaluating the "resistance to wraparound at high temperature". The assessment scale is shown below.

A: The maximum temperature at which the paper can travel through without wraparound is greater than or equal to 230° C.

B: The maximum temperature at which the paper can travel through without wraparound is greater than or equal to 210° C. and less than 230° C.

C: The maximum temperature at which the paper can travel through without wraparound is greater than or equal to 190° C. and less than 210° C.

D: The maximum temperature at which the paper can travel through without wraparound is less than 190° C.

TABLE 6

| | | | cleaning performance | | | | low-temperature fixability | | |
|---|---|---|---|---|---|---|---|---|---|
| | | | standing in a normal temperature, normal humidity environment | | standing in a high temperature environment | | | | resistance to wrap-around |
| | | storability | at 2000 prints | at 6000 prints | at 2000 prints | at 6000 prints | rubbing | blistering | at high temperature |
| Example 1 | toner 1 | A(60.0° C.) | A (absent) | A (absent) | A (absent) | A (absent) | A(140° C.) | A(130° C.) | A(240° C.) |
| Example 2 | toner 2 | A(60.0° C.) | A (absent) | A (absent) | A (absent) | A (absent) | B(160° C.) | A(150° C.) | A(250° C.) |

TABLE 6-continued

| | | | cleaning performance | | | | low-temperature fixability | | |
|---|---|---|---|---|---|---|---|---|---|
| | | | standing in a normal temperature, normal humidity environment | | standing in a high temperature environment | | | | resistance to wrap-around |
| | | storability | at 2000 prints | at 6000 prints | at 2000 prints | at 6000 prints | rubbing | blistering | at high temperature |
| Example 3 | toner 3 | B(57.5° C.) | A (absent) | B (observed in the 15th print) | A (absent) | B(observed in the 12th print) | A(130° C.) | A(150° C.) | B(220° C.) |
| Example 4 | toner 4 | A(60.0° C.) | A (absent) | A (absent) | A (absent) | A (absent during 15 prints) | B(160° C.) | A(150° C.) | A(250° C.) |
| Example 5 | toner 5 | A(60.0° C.) | A (absent) | A (absent) | A (absent) | A (absent during 15 prints) | A(130° C.) | A(130° C.) | A(230° C.) |
| Example 6 | toner 6 | B(57.5° C.) | A (absent) | B (observed in the 14th print) | A (absent) | B (observed in the 11th print) | A(130° C.) | A(130° C.) | A(230° C.) |
| Example 7 | toner 7 | A(60.0° C.) | A (absent) | A (absent) | A (absent) | A (absent during 15 prints) | B(170° C.) | B(170° C.) | A(250° C.) |
| Example 8 | toner 8 | A(60.0° C.) | A (absent) | A (absent) | A (absent) | A (absent during 15 prints) | A(160° C.) | B(170° C.) | A(250° C.) |
| Example 9 | toner 9 | B(57.5° C.) | A (absent) | B (observed in the 14th print) | A (absent) | B (observed in the 12th print) | B(160° C.) | B(170° C.) | A(240° C.) |
| Example 10 | toner 10 | A(60.0° C.) | A (absent) | A (absent) | A (absent) | A (absent during 15 prints) | B(170° C.) | C(180° C.) | A(250° C.) |
| Example 11 | toner 11 | C(55.0° C.) | A (absent) | A (absent) | A (absent) | A (absent during 15 prints) | A(130° C.) | A(130° C.) | A(230° C.) |
| Example 12 | toner 12 | A(60.0° C.) | A (absent) | A (absent) | A (absent) | A (absent during 15 prints) | B(160° C.) | A(150° C.) | A(250° C.) |
| Example 13 | toner 13 | A(60.0° C.) | A (absent) | B (observed in the 13th print) | A (absent) | B (observed in the 11th print) | A(130° C.) | A(130° C.) | A(230° C.) |
| Example 14 | toner 14 | A(60.0° C.) | A (absent) | A (absent) | A (absent) | A (absent during 15 prints) | C(180° C.) | C(190° C.) | A(250° C.) |
| Example 15 | toner 15 | A(60.0° C.) | A (absent) | C (observed in the 10th print) | A (absent) | C (observed in the 8th print) | A(130° C.) | A(130° C.) | A(230° C.) |
| Example 16 | toner 16 | A(60.0° C.) | A (absent) | A (absent) | B (observed in the 15th print) | B (observed in the 12th print) | A(140° C.) | A(130° C.) | A(240° C.) |
| Example 17 | toner 17 | A(60.0° C.) | A (absent) | A (absent) | B (observed in the 15th print) | B (observed in the 12th print) | A(140° C.) | A(130° C.) | A(240° C.) |
| Example 18 | toner 18 | A(60.0° C.) | A (absent) | A (absent) | C (observed in the 10th print) | C (observed in the 7th print) | A(140° C.) | A(130° C.) | A(240° C.) |
| Example 19 | toner 19 | A(60.0° C.) | A (absent) | A (absent) | C (observed in the 10th print) | C (observed in the 7th print) | A(140° C.) | A(130° C.) | A(240° C.) |
| Example 20 | toner 20 | C(55.0° C.) | A (absent) | C (observed in the 10th print) | B (observed in the 14th print) | C (observed in the 8th print) | A(130° C.) | A(130° C.) | C(200° C.) |
| Example 21 | toner 21 | B(57.5° C.) | B (observed in the 13th print) | B (observed in the 11th print) | C (observed in the 10th print) | C (observed in the 8th print) | B(160° C.) | B(160° C.) | A(230° C.) |
| Example 22 | toner 22 | C(55.0° C.) | C (observed in the 10th print) | C (observed in the 8th print) | C (observed in the 6th print) | C (observed in the 6th print) | B(160° C.) | B(160° C.) | C(200° C.) |
| Example 23 | toner 23 | A(60.0° C.) | A (absent) | A (absent) | A (absent) | A (absent) | A(140° C.) | A(130° C.) | A(250° C.) |
| Example 24 | toner 24 | B(57.5° C.) | A (absent) | B (observed in the 15th print) | B (observed in the 14th print) | B (observed in the 12th print) | A(140° C.) | A(130° C.) | B(220° C.) |
| Example 25 | toner 25 | B(57.5° C.) | A (absent) | A (absent) | A (absent) | A (absent) | A(140° C.) | A(130° C.) | B(220° C.) |
| Example 26 | toner 26 | C(55.0° C.) | B (observed in the 13th print) | B (observed the in 11th print) | C (observed in the 10th print) | C (observed in the 8th print) | A(150° C.) | A(140° C.) | A(240° C.) |
| Example 27 | toner 27 | C(55.0° C.) | A (absent) | A (absent) | B (observed in the 14th print) | B (observed in the 11th print) | A(150° C.) | A(140° C.) | A(240° C.) |
| Comparative Example 1 | toner 28 | A(60.0° C.) | A (absent) | A (absent) | C (observed in the 10th print) | C (observed in the 7th print) | D(190° C.) | D(200° C.) | A(250° C.) |
| Comparative Example 2 | toner 29 | D(50.0° C.) | A (absent) | A (absent) | D (observed in the 5th print) | D (observed in the 3rd print) | A(130° C.) | A(130° C.) | D(180° C.) |
| Comparative Example 3 | toner 30 | A(60.0° C.) | A (absent) | A (absent) | C (observed in the 10th print) | C (observed in the 7th print) | D(190° C.) | D(200° C.) | A(250° C.) |
| Comparative Example 4 | toner 31 | D(50.0° C.) | A (absent) | A (absent) | D (observed in the 5th print) | D (observed in the 3rd print) | A(130° C.) | A(130° C.) | D(180° C.) |
| Comparative Example 5 | toner32 | D(52.5° C.) | C (observed in the 10th print) | C (observed in the 6th print) | D (observed in the 5th print) | D (observed in the 2nd print) | A(130° C.) | A(130° C.) | C(180° C.) |
| Comparative Example 6 | toner 33 | A(60.0° C.) | A (absent) | A (absent) | C (observed in the 10th print) | C (observed in the 7th print) | D(190° C.) | D(200° C.) | A(240° C.) |
| Comparative Example 7 | toner 34 | C(55.0° C.) | A (absent) | A (absent) | D (observed in the 5th print) | D (observed in the 3rd print) | D(190° C.) | D(200° C.) | A(250° C.) |

The invention claimed is:

1. A toner having toner particles, each of which contains a binder resin and a colorant, wherein, when dynamic viscoelastic properties of the toner are measured in a temperature range from at least 30° C. to not more than 200° C., i) with Tp [° C.] being a temperature at which a loss elastic modulus exhibits the maximum value, Tp is from at least 40° C. to not more than 55° C., and ii) with G"(Tp) [Pa] being the loss elastic modulus at the temperature of Tp [° C], G"(Tp+15) [Pa] being the loss elastic modulus at the temperature of Tp+15[° C.], and G"(Tp+30) [Pa] being the loss elastic modulus at the temperature of Tp+30[° C.], G"(Tp), G"(Tp+15), and G"(Tp+30) satisfy following equations (1), (2), and (3):

$$8.00\times10^{7}\leq G''(Tp)\leq3.00\times10^{8} \quad (1)$$

$$G''(Tp)/G''(Tp+15)\leq6.00 \quad (2)$$

$$50.0\leq G''(Tp+15)/G''(Tp+30) \quad (3).$$

2. The toner according to claim 1, wherein the G"(Tp+15) is from at least $2.00\times10^{7}$ Pa to not more than $1.00\times10^{8}$ Pa.

3. The toner according to claim 1, wherein each toner particle contains a carboxyl group-containing vinyl resin, and the weight-average molecular weight (Mw) of this carboxyl group-containing vinyl resin, as measured by gel permeation chromatography (GPC), is from at least $1.00\times10^{4}$ to not more than $5.00\times10^{4}$.

4. The toner according to claim 3, wherein the peak molecular weight (Mp) in a molecular weight distribution of the carboxyl group-containing vinyl resin as measured by gel permeation chromatography (GPC) is from at least $1.00\times10^{4}$ to not more than $3.00\times10^{4}$, and with a high molecular weight component being the resin component that elutes prior to elution time that gives the peak molecular weight (Mp) and a low molecular weight component being the resin component that elutes after elution time for the peak molecular weight (Mp), an acid value $\alpha$ [mg KOH/g] of the low molecular weight component and an acid value $\beta$ [mg KOH/g] of the high molecular weight component satisfy $0.80\leq\alpha/\beta\leq1.20$.

5. The toner according to claim 1, wherein the toner particles are obtained by: adding a polymerizable monomer composition containing a polymerizable monomer and a colorant to an aqueous medium; forming particles of the polymerizable monomer composition in the aqueous medium; and polymerizing the polymerizable monomer contained in the particles.

* * * * *